US011795945B2

(12) United States Patent
Takehana

(10) Patent No.: US 11,795,945 B2
(45) Date of Patent: Oct. 24, 2023

(54) PUMP DEVICE WITH AIR INTRODUCTION HOLE THAT OPENS INTO PUMP CHAMBER AT PREDETERMINED OPENING TIME IMMEDIATELY BEFORE SUCTION STROKE

(71) Applicant: MIKUNI CORPORATION, Tokyo (JP)

(72) Inventor: Norio Takehana, Iwate (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 17/696,902

(22) Filed: Mar. 17, 2022

(65) Prior Publication Data

US 2022/0341419 A1 Oct. 27, 2022

(30) Foreign Application Priority Data

Apr. 26, 2021 (JP) ..... 2021-073773

(51) Int. Cl.
*F04C 2/10* (2006.01)
*F04C 15/06* (2006.01)
*F04C 15/00* (2006.01)

(52) U.S. Cl.
CPC ..... *F04C 2/102* (2013.01); *F04C 2/10* (2013.01); *F04C 15/0049* (2013.01); *F04C 15/06* (2013.01); *F04C 2210/206* (2013.01); *F04C 2240/60* (2013.01); *F04C 2270/12* (2013.01); *F04C 2270/13* (2013.01)

(58) Field of Classification Search
CPC .. F04C 2/10; F04C 2/102; F04C 18/10; F04C 18/102; F04C 15/0042; F04C 15/0049; F04C 15/06; F04C 29/0007; F04C 29/0021; F04C 29/0035; F04C 29/042; F04C 29/12; F01C 1/10; F01C 1/103; F01C 21/001; F01C 21/003; F01C 21/006; F01C 21/18
See application file for complete search history.

(56) References Cited

U.S. PATENT DOCUMENTS

2014/0356195 A1* 12/2014 Tojo ..... F04C 15/066 417/222.2
2016/0186753 A1* 6/2016 Oda ..... F04C 2/10 418/166

FOREIGN PATENT DOCUMENTS

| | | | |
|---|---|---|---|
| DE | 102019120238 | A1 * | 1/2021 |
| JP | 2003293964 | | 10/2003 |
| JP | 2010053785 | | 3/2010 |
| JP | 2018105291 | | 7/2018 |
| WO | WO-2018198451 | A1 * | 11/2018 |

* cited by examiner

*Primary Examiner* — Laert Dounis
(74) *Attorney, Agent, or Firm* — JCIPRNET

(57) ABSTRACT

The disclosure provides a pump device capable of suppressing hydraulic amplitude and reducing noise or vibration associated with hydraulic amplitude while simplifying the structure. The pump device includes: a housing which defines a suction port, a discharge port, and an accommodation chamber; and a pump unit which is arranged in the accommodation chamber and which defines a pump chamber that expands and contracts to exert a pumping action including a suction stroke and a pressurization and discharge stroke on a fluid. The housing includes an air introduction hole that is opened to introduce air into the pump chamber at a predetermined opening timing immediately before the suction stroke is completed.

10 Claims, 23 Drawing Sheets

PUMP DEVICE WITH AIR INTRODUCTION HOLE THAT OPENS INTO PUMP CHAMBER AT PREDETERMINED OPENING TIME IMMEDIATELY BEFORE SUCTION STROKE

CROSS-REFERENCE TO RELATED APPLICATION

This application claims the priority benefit of Japan application serial no. 2021-073773, filed on Apr. 26, 2021. The entirety of the above-mentioned patent application is hereby incorporated by reference herein and made a part of this specification.

BACKGROUND

Technical Field

The disclosure relates to a pump device that sucks fluid, pressurizes it, and discharges it, and more particularly to a pump device that includes an inner rotor and an outer rotor and is applied to a cylinder block of an internal combustion engine, a fluid device, or the like.

Description of Related Art

As a conventional pump device, a trochoid pump is known which includes a casing having a suction port and a discharge port, an inner rotor and an outer rotor as a pump unit housed in an accommodation space of the casing, and a pump shaft that rotates integrally with the inner rotor, and which pressurizes and supplies the hydraulic oil of an engine (see, for example, Patent Literature 1).

In this trochoid pump, the outer rotor rotates in conjunction with the rotation of the pump shaft and the inner rotor, and the gap (pump chamber) between the inner and outer teeth of both repeatedly expands and contracts, whereby the suction stroke for sucking the hydraulic oil and the pressurization and discharge stroke for pressurizing and discharging the sucked hydraulic oil are continuously repeated.

In this pump operation, in particular, when the rotation of the pump shaft becomes high, the suction resistance of the hydraulic oil increases, and when the suction stroke is completed, the inside of the pump chamber becomes a negative pressure state. Then, at the moment when the pump chamber in which the suction stroke is completed communicates with the discharge port side, the hydraulic oil in the pump chamber in the previous pressurization and discharge stroke flows back, and then the backflow stops and the forward flow occurs.

Due to this backflow and forward flow phenomenon, the hydraulic pressure of the hydraulic oil in the pump chamber in the pressurization and discharge stroke causes an increase in hydraulic pressure fluctuation (hydraulic amplitude) that repeatedly decreases and increases as the pump shaft rotates; as a result, it causes noise and vibration. Further, when the negative pressure becomes excessive, problems such as impact noise due to cavitation and erosion of the rotor occur.

In addition, in order to suppress the hydraulic amplitude with the same discharge amount, it is conceivable to adopt an inner rotor and an outer rotor having a large number of teeth to divide the discharge into smaller parts and increase the number of discharges. However, this leads to an increase in the size of the entire pump. Further, it is also conceivable to adopt a method of arranging the pump unit in two stages and similarly performing discharges alternately to increase the number of discharges, but the number of parts increases, which leads to high cost and an increase in the size of the entire pump.

Further, as a conventional pump device, an oil pump device or a trochoid pump in which an outer rotor or an inner rotor is divided into multiple pieces to reduce noise has been proposed (for example, see Patent Literature 2 and Patent Literature 3).

However, such pump devices allow the backflow of the hydraulic oil and do not suppress the increase in hydraulic pressure fluctuation (hydraulic amplitude) caused by the backflow of the hydraulic oil.

RELATED ART

Patent Literature

[Patent Literature 1] Japanese Patent Laid-open No. 2018-105291

[Patent Literature 2] Japanese Patent Laid-open No. 2003-293964

[Patent Literature 3] Japanese Patent Laid-open No. 2010-53785

SUMMARY

Technical Problem

The disclosure has been made in view of the above circumstances, and the disclosure solves the above-mentioned problems of the conventional technology and provides a pump device capable of suppressing hydraulic amplitude and reducing noise or vibration associated with hydraulic amplitude while simplifying the structure.

Solution to Problem

A pump device according to the disclosure includes: a housing which defines a suction port, a discharge port, and an accommodation chamber; and a pump unit which is arranged in the accommodation chamber and which defines a pump chamber that expands and contracts to exert a pumping action including a suction stroke and a pressurization and discharge stroke on a fluid. The housing includes an air introduction hole that is opened to introduce air into the pump chamber at a predetermined opening timing immediately before the suction stroke is completed.

In the above pump device, a configuration may be adopted in which the air introduction hole is closed at a predetermined closing timing after the suction stroke is completed.

In the above pump device, a configuration may be adopted in which the pump unit includes an inner rotor that rotates around a predetermined axis and an outer rotor that rotates in conjunction with the rotation of the inner rotor.

In the above pump device, a configuration may be adopted in which the housing includes the air introduction hole in a wall part on which an end surface of the inner rotor and an end surface of the outer rotor slide.

In the above pump device, a configuration may be adopted in which the air introduction hole is provided at a position where it is opened and closed by the end surface of the inner rotor.

In the above pump device, a configuration may be adopted in which the discharge port includes a deviated opening region that is opened in deviation toward an outer peripheral side region of the outer rotor to discharge a fluid pressurized by the pump chamber from the outer peripheral side region of the outer rotor away from the inner rotor for a predetermined period from the start of the pressurization and discharge stroke.

In the above pump device, a configuration may be adopted in which the inner rotor and the outer rotor are trochoid rotors having a trochoidal tooth profile of four blades and five nodes.

In the above pump device, a configuration may be adopted in which when a rotation angle of the inner rotor over a range of the suction stroke is $\Theta$, and a rotation angle of the inner rotor from the opening timing to the completion of the suction stroke is $\Delta\Theta a$, $\Delta\Theta a$ is set in a range of $0.08\times\Theta<\Delta\Theta a<0.12\times\Theta$.

In the above pump device, a configuration may be adopted in which when a rotation angle of the inner rotor over a range of the suction stroke is $\Theta$, and a rotation angle of the inner rotor from the opening timing to the completion of the suction stroke is $\Delta\Theta a$, and a rotation angle of the inner rotor from the completion of the suction stroke to the closing timing is $\Delta\Theta b$, $\Delta\Theta a$ is set in a range of $0.08\times\Theta<\Delta\Theta a<0.12\times\Theta$, and $\Delta\Theta b$ is set in a range of $0.6\times\Delta\Theta a<\Delta\Theta b<0.7\times\Delta\Theta a$.

In the above pump device, a configuration may be adopted which further includes a check valve which allows only air flow introduced from the air introduction hole into the pump chamber.

In the above pump device, a configuration may be adopted in which the housing includes: a housing body in a bottomed tubular shape which defines the suction port, the discharge port, a joint wall to be joined to an application object, and the accommodation chamber; and a housing cover in a flat plate shape which is combined to the housing body to close the accommodation chamber, and the air introduction hole is provided in the housing cover.

In the above pump device, a configuration may be adopted in which the housing includes: a housing body in a bottomed tubular shape which defines the accommodation chamber; and a housing cover in a flat plate shape which defines the suction port, the discharge port, and a joint wall to be joined to an application object, and which is combined to the housing body to close the accommodation chamber, and the air introduction hole is provided in the housing body.

Effects

According to the pump device having the above configuration, it is capable of suppressing hydraulic amplitude and reducing noise or vibration associated with hydraulic amplitude while simplifying the structure.

DESCRIPTION OF EMBODIMENTS

Hereinafter, embodiments of the disclosure will be described with reference to the accompanying drawings.

A pump device M1 according to the first embodiment is applied to an internal combustion engine E as an application object.

Figure 1:
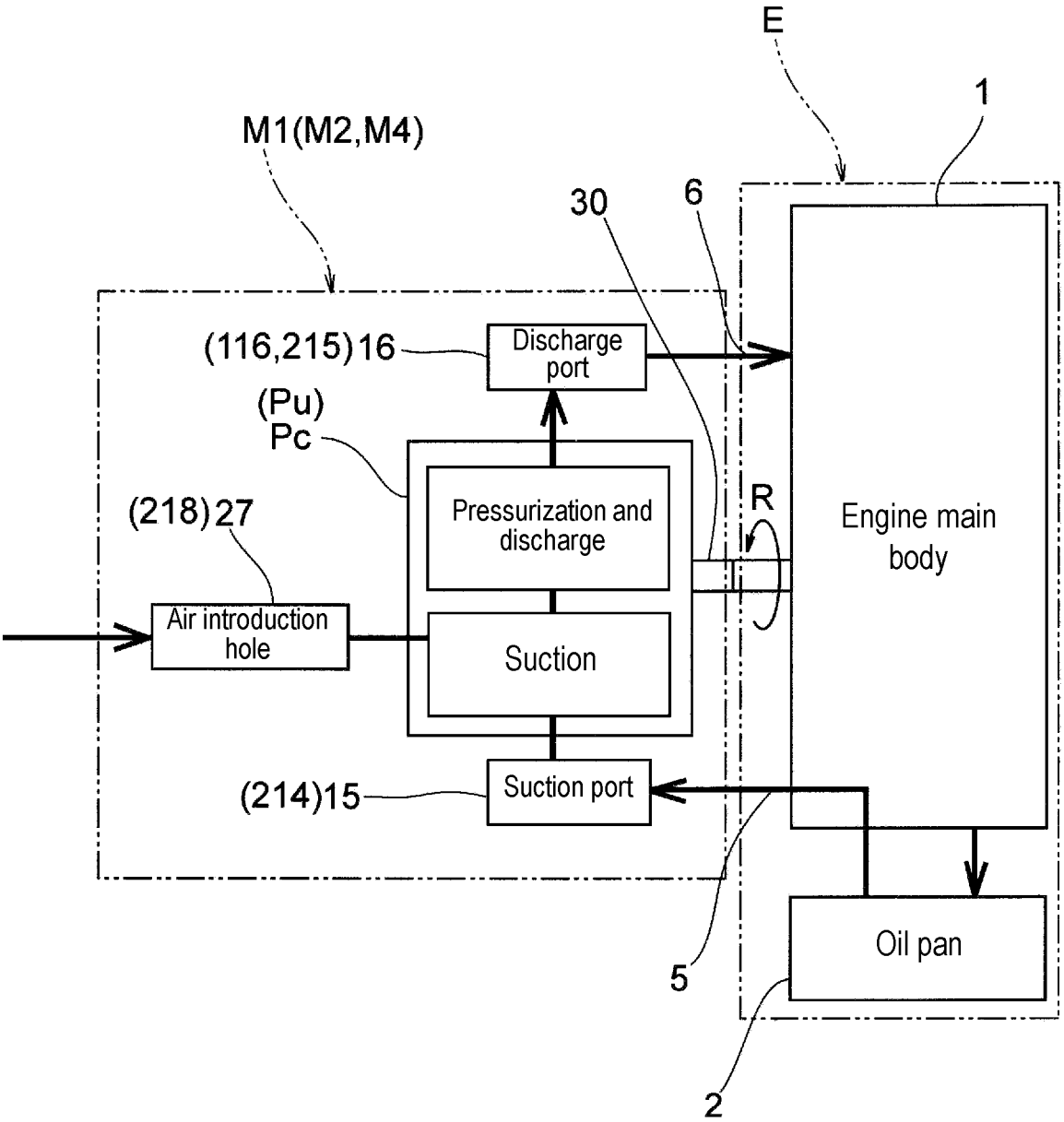
FIG. 1 is a block diagram of a system in which a pump device according to the first embodiment of the disclosure is applied to an application object (internal combustion engine).
Figure 2:
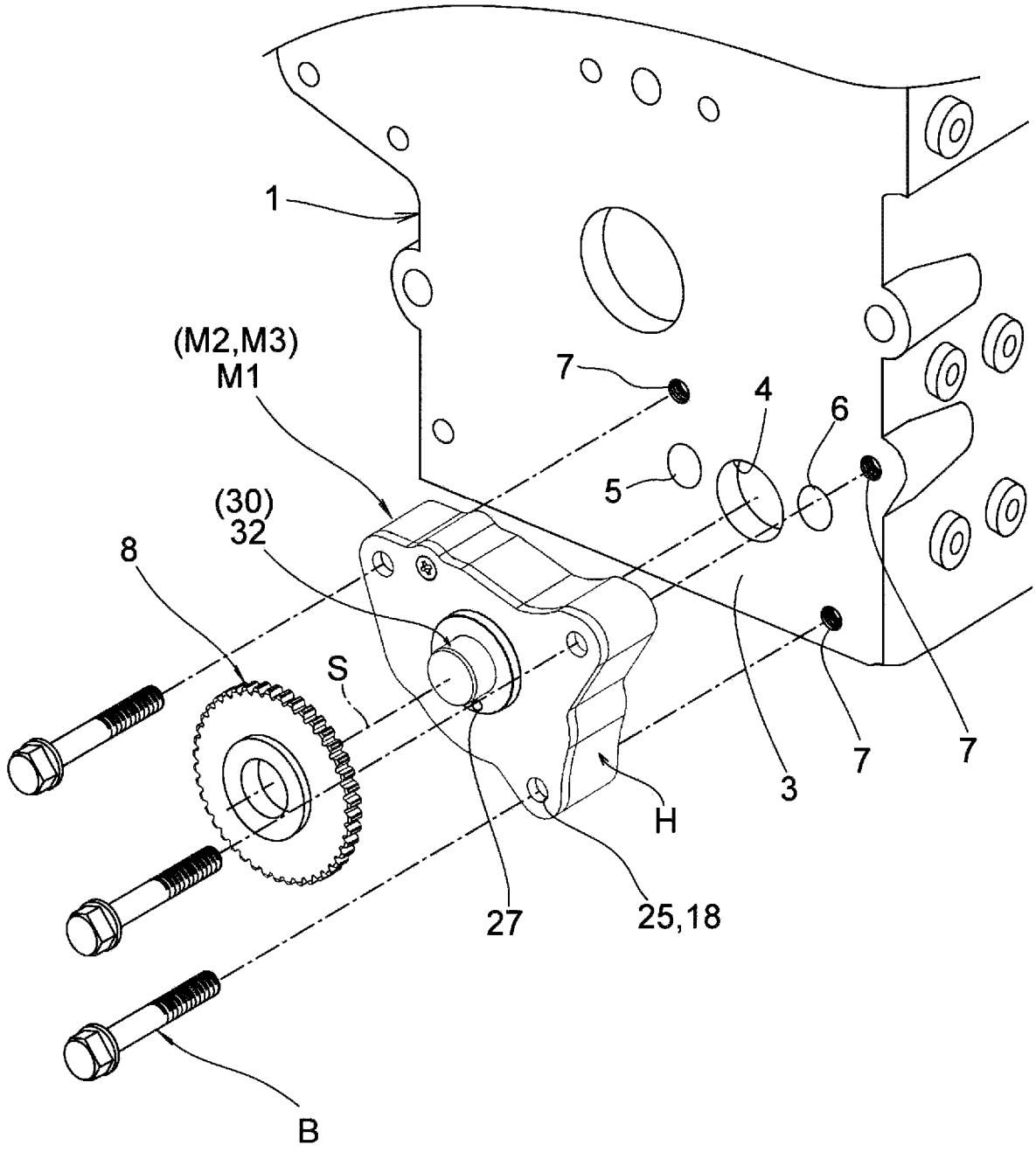
FIG. 2 is an exploded perspective diagram showing a state before the pump device according to the first embodiment is attached to the application object (internal combustion engine).
Figure 3:
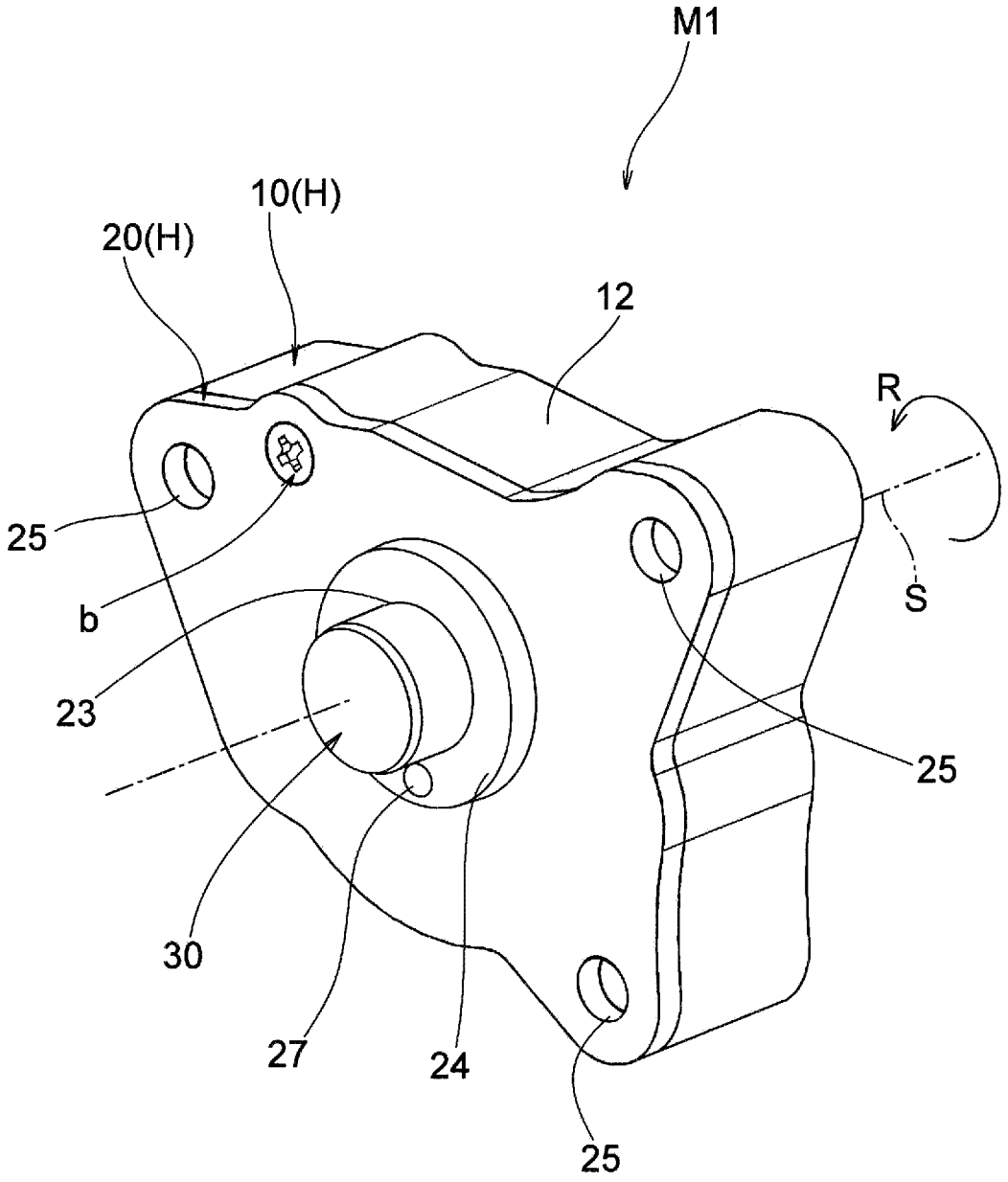
FIG. 3 is an external perspective diagram of the pump device according to the first embodiment as viewed from the side opposite to the joint wall where the pump device is joined to the application object.

Here, as shown in FIGS. 1 and 2, the internal combustion engine E includes an engine main body 1 and an oil pan 2 combined to the lower side of the engine main body 1. The engine main body 1 includes a joint surface 3 for joining the pump device M1, a cylindrical fitting recess 4, an outflow passage 5 of hydraulic oil, an inflow passage 6 of hydraulic oil, three screw holes 7 for screwing bolts B, and the like.

As shown in FIGS. 3 to 6, the pump device M1 includes a housing body 10 and a housing cover 20 as a housing H, a rotation shaft 30 centered on a predetermined axis S, an inner rotor 40 and an outer rotor 50 as a pump unit Pu, and a screw b for fastening the housing cover 20 to the housing body 10.

Figure 5:
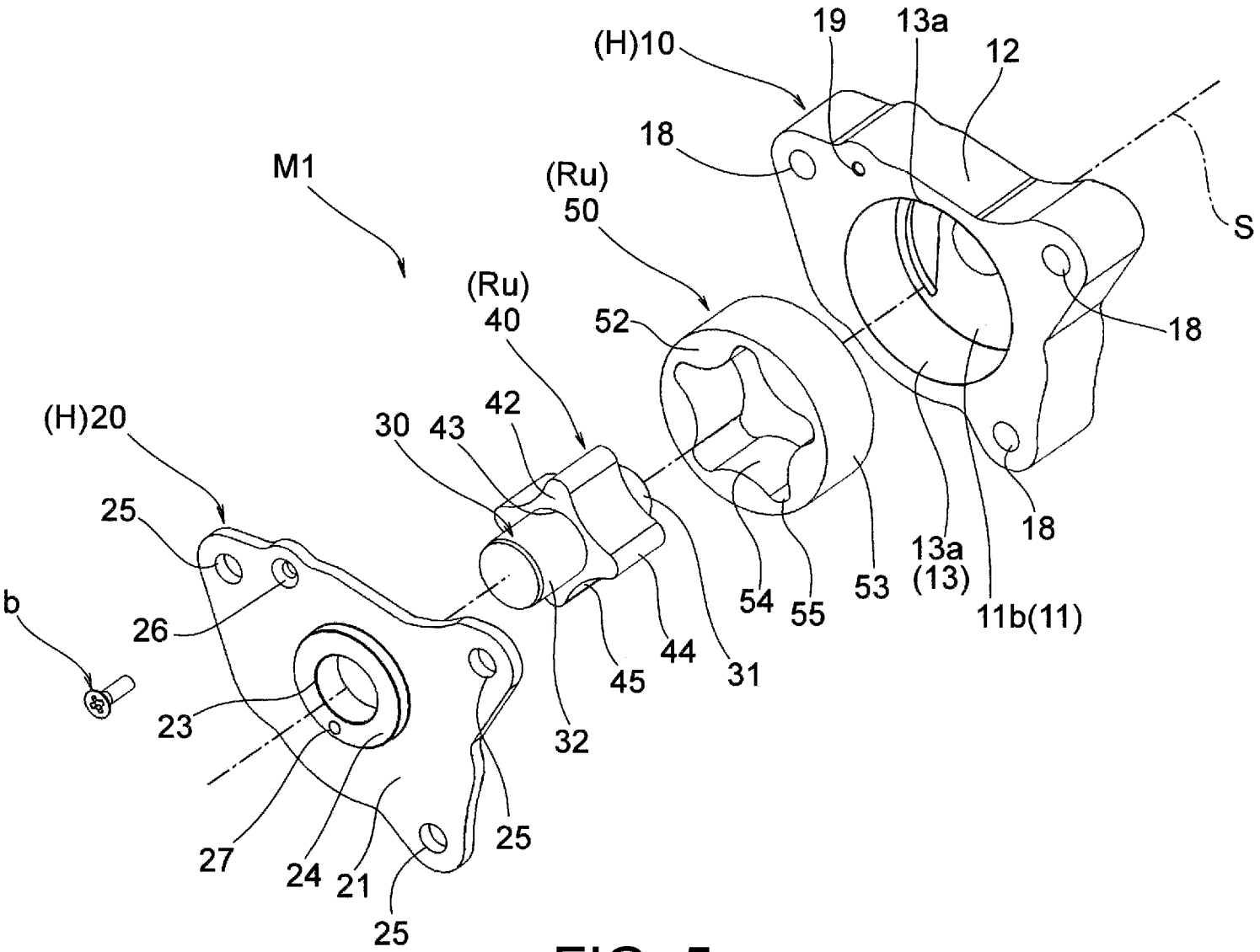
FIG. 5 is an exploded perspective diagram of the pump device shown in FIG. 3.
Figure 6:
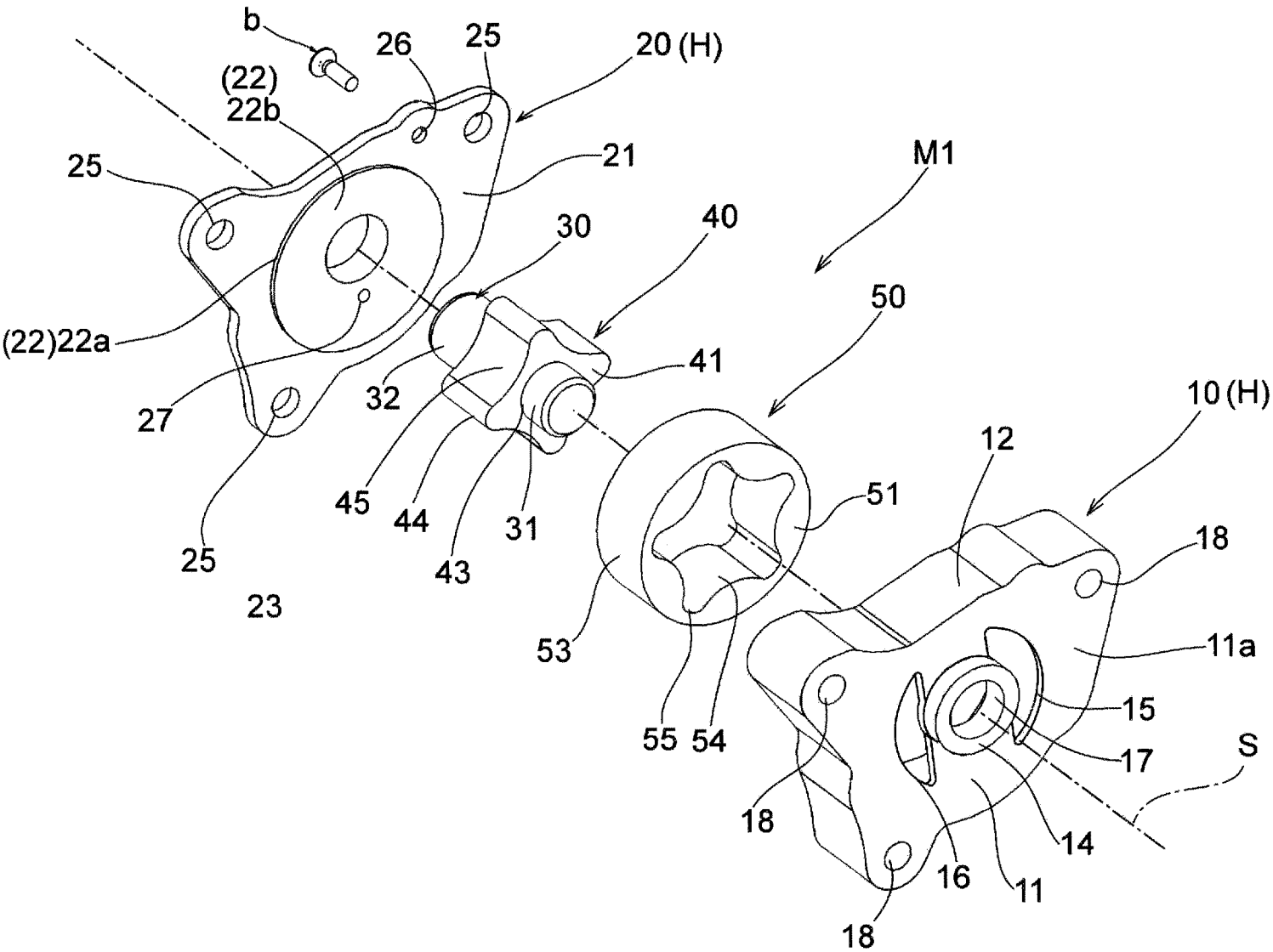
FIG. 6 is an exploded perspective diagram of the pump device shown in FIG. 4.

The housing body 10 is formed in a bottomed tubular shape using a metal material such as steel, cast iron, sintered steel, aluminum alloy, or the like, and as shown in FIGS. 5 and 6, includes a joint wall 11, an outer peripheral wall 12, an accommodation chamber 13, an inlay part 14, a suction port 15, a discharge port 16, a bearing hole 17, three insertion holes 18, and one screw hole 19.

Figure 7:
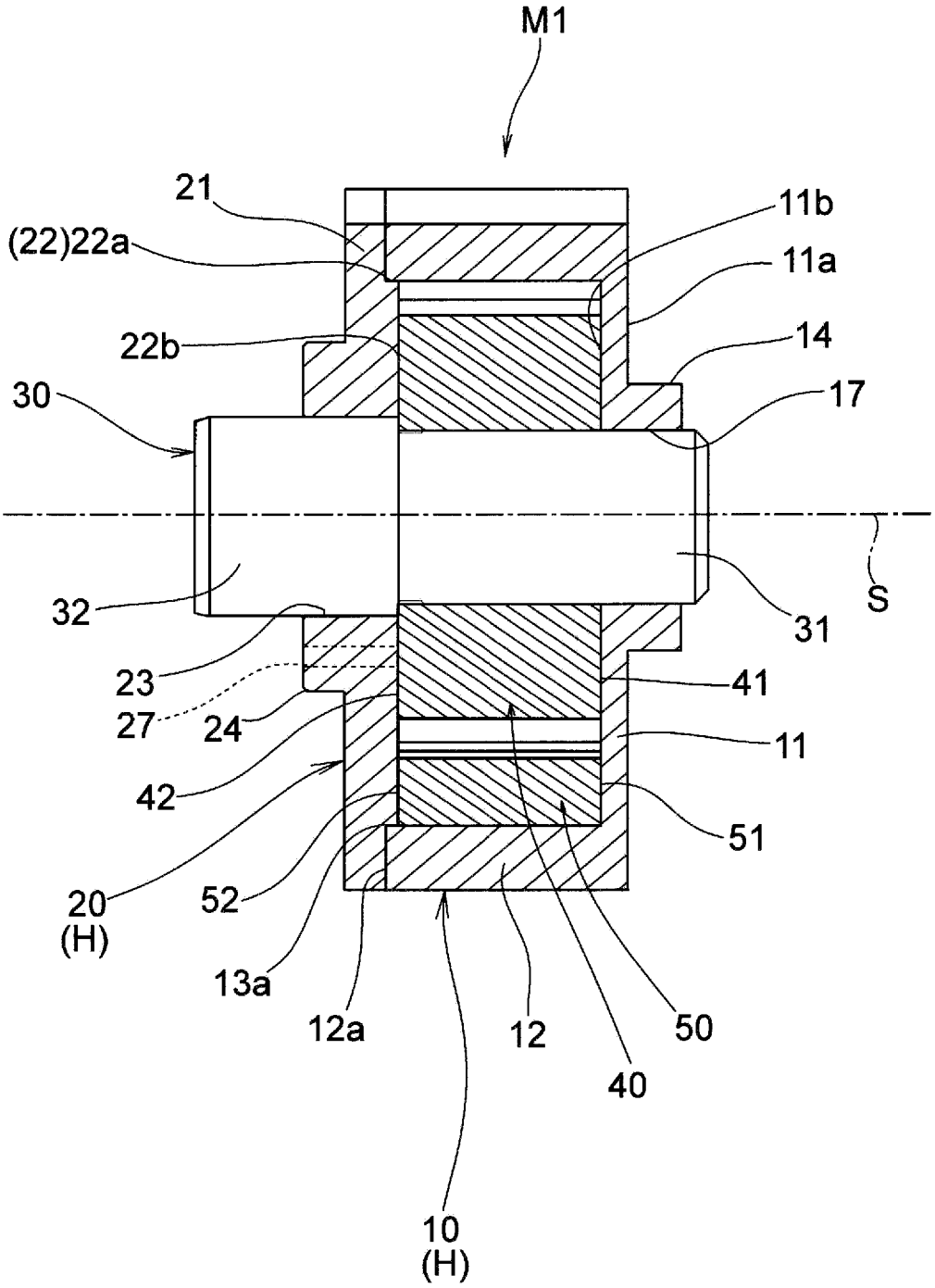
FIG. 7 is a cross-sectional diagram of the pump device according to the first embodiment cut along a plane passing through the axis of the rotation shaft.

As shown in FIG. 7, the joint wall 11 is formed as a flat wall perpendicular to the axis S, and defines an outer wall surface 11*a* joined to the joint surface 3 of the engine main body 1 and an inner wall surface 11*b* on which end surfaces 41 and 51 of the pump unit Pu slide in close contact with each other.

The outer peripheral wall 12 protrudes from the outer edge region of the joint wall 11 in a tubular shape in the axis S direction to define an annular end surface 12*a*.

The accommodation chamber 13 is a space defined by the joint wall 11 and the outer peripheral wall 12, and rotatably accommodates the pump unit Pu.

Figure 8:
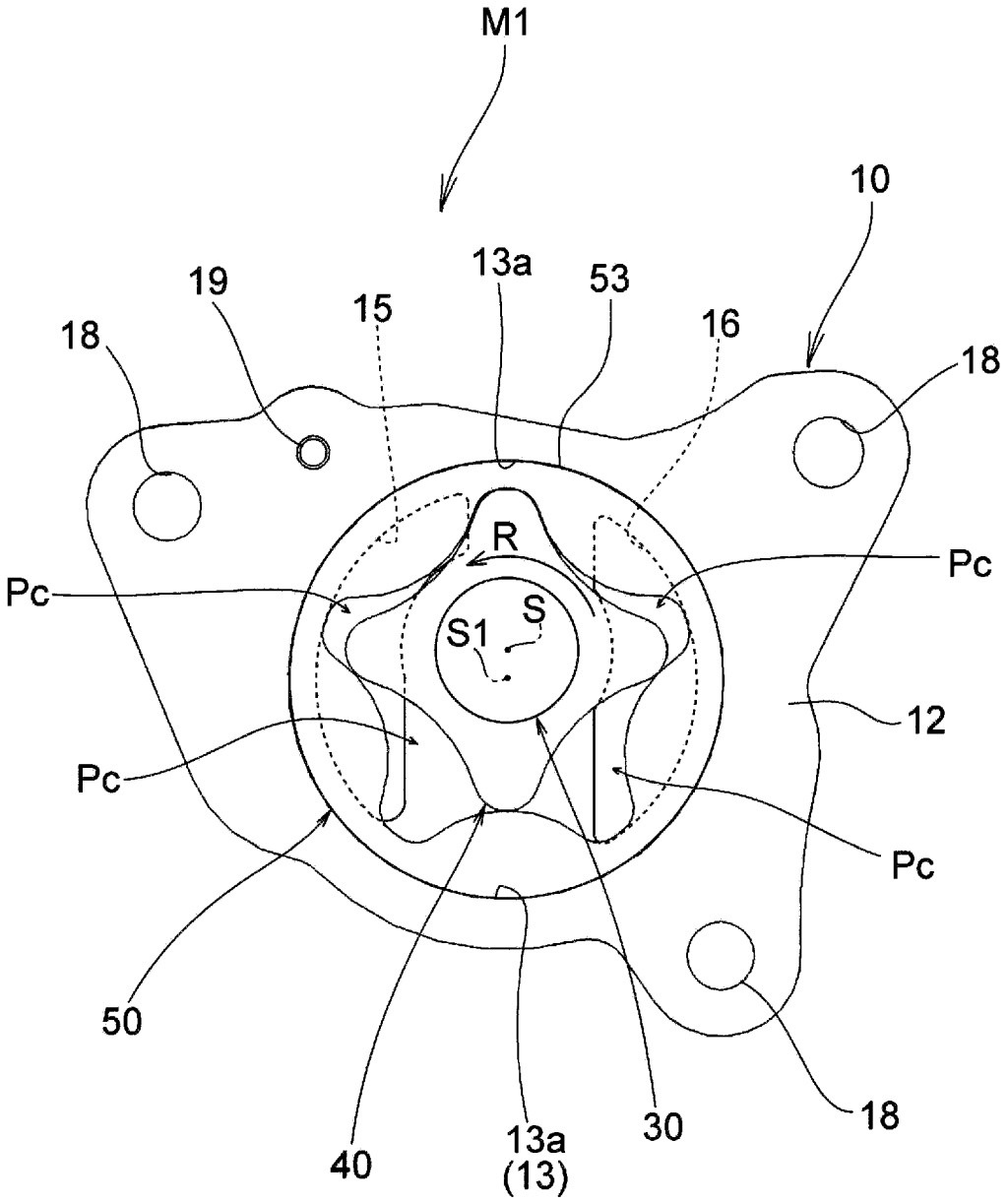
FIG. 8 is a front diagram showing the relationship between the pump unit (inner rotor and outer rotor) included in the pump device according to the first embodiment, the suction port, and the discharge port with the housing cover removed.

Further, as shown in FIG. 8, the accommodation chamber 13 includes an arc surface 13*a* forming a cylindrical surface centered on an axis S1 deviated in parallel from the axis S.

The arc surface 13*a* slidably supports an outer peripheral surface 53 of the outer rotor 50 forming a part of the pump unit Pu. Further, the inner edge part of the arc surface 13*a* also functions as a fitting recess into which a fitting protrusion 22 of the housing cover 20 is fitted.

The inlay part 14 protrudes outward from the joint wall 11 in the axis S direction and is formed in a cylindrical shape centered on the axis S, and is closely fitted to the fitting recess 4 of the engine main body 1.

Figure 4:
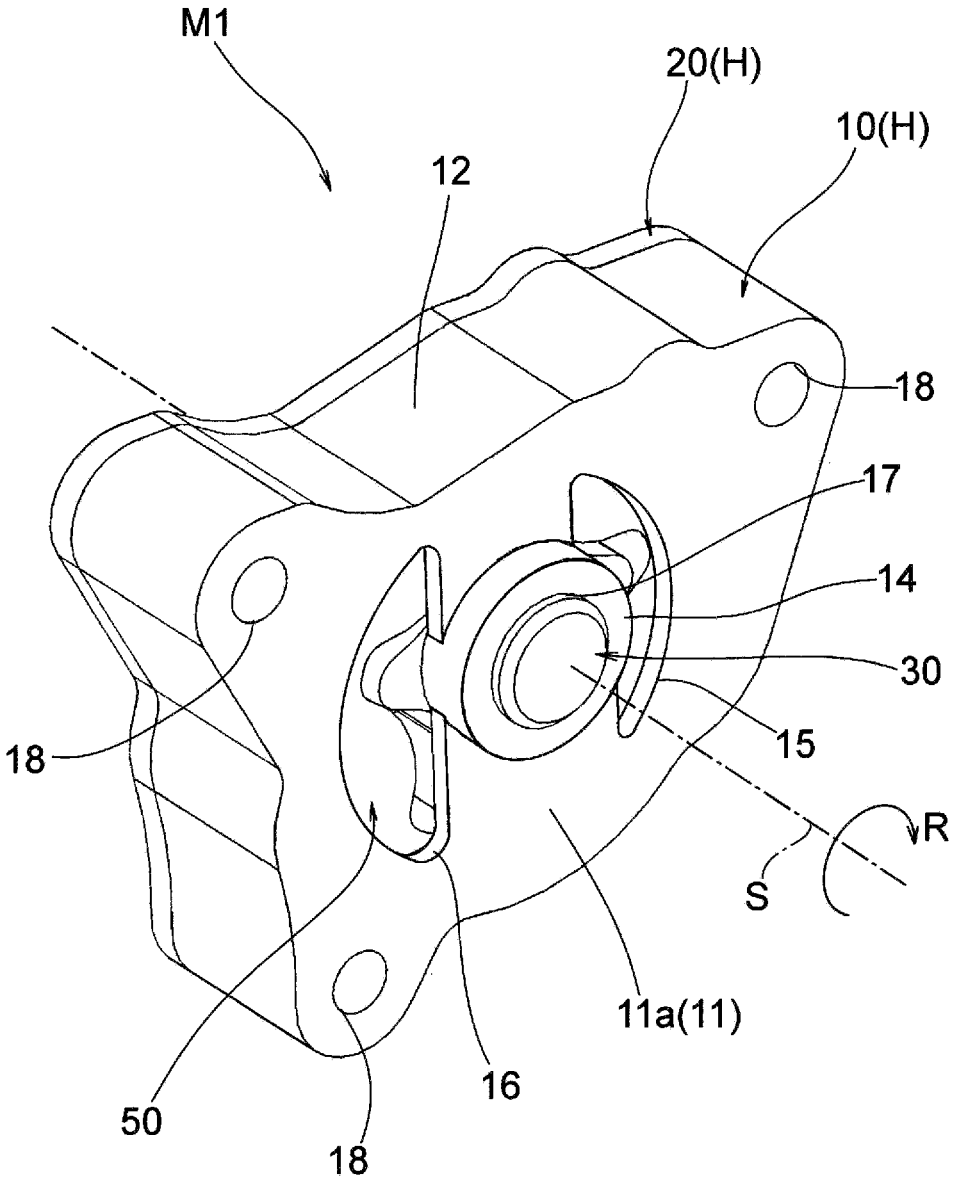
FIG. 4 is an external perspective diagram of the pump device according to the first embodiment as viewed from the joint wall side where the pump device is joined to the application object.

As shown in FIGS. 4, 6, and 8, the suction port 15 is formed in the joint wall 11 by penetrating from the outer wall surface 11*a* to the inner wall surface 11*b* to form a substantially crescent-shaped contour. Then, in a state where the pump device M1 is joined to the joint surface 3 of the engine main body 1, the hydraulic oil guided from the outflow passage 5 is sucked into a pump chamber Pc through the suction port 15.

As shown in FIGS. 4, 6, and 8, the discharge port 16 is formed by penetrating from the outer wall surface 11*a* to the inner wall surface 11*b* to form a substantially crescent-shaped contour in a region of the joint wall 11 on the side opposite to the suction port 15 with the inlay part 14 interposed therebetween.

The bearing hole 17 is formed in a cylindrical shape centered on the axis S inside the inlay part 14 to rotatably support a one-end-side region 31 of the rotation shaft 30.

The three insertion holes 18 are for inserting the bolts B to be screwed into the screw holes 7 of the engine main body 1, and are formed to penetrate from the end surface 12*a* to the outer wall surface 11*a* in the axis S direction.

The one screw hole 19 is formed in the end surface 12*a* for screwing the screw b that connects the housing cover 20 to the housing body 10.

The housing cover 20 is combined to the housing body 10 to close the accommodation chamber 13 of the housing body 10, and is formed in a flat plate shape using a material such as steel, cast iron, sintered steel, or an aluminum alloy.

Then, as shown in FIGS. 5 to 7, the housing cover 20 includes a connection wall 21, a fitting protrusion 22, a bearing hole 23, an annular protrusion 24, three insertion holes 25, one circular hole 26, and an air introduction hole 27.

The connection wall 21 is formed as a flat wall perpendicular to the axis S and is closely combined to the end surface 12*a* of the housing body 10.

The fitting protrusion 22 is formed in a disk shape near the center of the housing cover 20 to protrude from the connection wall 21 in the axis S direction with the axis S1 as the center, and defines an outer peripheral surface 22*a* and an inner wall surface 22*b*. The outer peripheral surface 22*a* is fitted to the inner edge part of the arc surface 13*a* of the housing body 10. The inner wall surface 22*b* is in close contact with end surfaces 42 and 52 of the pump unit Pu.

The bearing hole 23 is formed in a cylindrical shape centered on the axis S to rotatably support an other-end-side region 32 of the rotation shaft 30.

The annular protrusion 24 is formed in a cylindrical shape around the bearing hole 23 to protrude outward in the axis S direction in order to increase the mechanical strength.

The three insertion holes 25 are for inserting the bolts B to be screwed into the screw holes 7 of the engine main body 1, and are formed as circular holes penetrating in the axis S direction at positions corresponding to the three insertion holes 18 of the housing body 10.

The one circular hole 26 is for passing the screw b that connects the housing cover 20 to the housing body 10, and is formed near the one insertion hole 25.

The air introduction hole 27 is formed as a circular hole penetrating in the axis S direction in the wall part located in the region of the annular protrusion 24 and in the region of the inner wall surface 22*b* on which the inner rotor 40 slides in order to introduce the outside air into the pump chamber Pc defined by the pump unit Pu.

Further, the air introduction hole 27 is opened by the end surface 42 of the inner rotor 40 at a predetermined opening timing immediately before the suction stroke by the pump unit Pu is completed, and is closed by the end surface 42 of the inner rotor 40 at a predetermined closing timing after the suction stroke is completed.

As described above, the housing H includes: the housing body 10 in a bottomed tubular shape that defines the suction port 15, the discharge port 16, the joint wall 11 to be joined to the internal combustion engine E which is the application object, and the accommodation chamber 13; and the housing cover 20 in a flat plate shape that is combined to the housing body 10 to close the accommodation chamber 13; and the air introduction hole 27 is provided in the housing cover 20.

As described above, since the air introduction hole 27 is provided in the housing H in the region opposite to the side to be joined to the application object, there is no obstacle on the outside of the air introduction hole 27 and air (outside air) can be smoothly introduced into the pump chamber Pc.

The rotation shaft 30 is formed in a columnar shape extending in the axis S direction using a steel material or the like; the one-end-side region 31 of the rotation shaft 30 is fitted into the bearing hole 17 of the housing body 10, and the other-end-side region 32 of the rotation shaft 30 is fitted into the bearing hole 23 of the housing cover 20, and the rotation shaft 30 is rotatably supported around the axis S.

In FIG. 7, the rotation shaft 30 is shown in a simple form slightly protruding from the housing H in the axis S direction, and the details of the end parts are omitted.

Actually, the rotation shaft 30 is formed to be connected to a driven rotating body such as a gear, a sprocket, or a pulley at the other-end-side region 32 protruding from the housing cover 20, for example, when the driving force of the driving rotating body of the internal combustion engine is transmitted, or the rotation shaft 30 is formed to be connected to the driving rotating body directly or via a transmission member at the other-end-side region 32, for example, when the driving force of the driving rotating body (such as a rotor or a driving shaft) of the electric motor is transmitted.

The rotation shaft 30 is formed to be directly connected to the driving rotating body at the one-end-side region 31 protruding from the joint wall 11 of the housing body 10, for example, when the driving force of the driving rotating body of the internal combustion engine is transmitted.

In this embodiment, as shown in FIG. 2, a gear 8 is connected to the other-end-side region 32, and the driving force of the driving rotating body of the internal combustion engine E is transmitted.

The pump unit Pu is arranged in the accommodation chamber 13 of the housing H, defines the pump chamber Pc that expands and contracts to exert a pumping action including a suction stroke and a pressurization and discharge stroke on the hydraulic oil as a fluid, and is configured as a four-blade five-node trochoid rotor including the inner rotor 40 and the outer rotor 50.

The inner rotor 40 is formed as an external gear having a trochoidal curved tooth profile by using a metal material such as steel or sintered steel. Then, as shown in FIGS. 5 to 7, the inner rotor 40 includes an end surface 41 that slides on the inner wall surface 11*b* of the housing body 10, an end surface 42 that slides on the inner wall surface 22*b* of the housing cover 20, a fitting hole 43 for fitting the rotation shaft 30, four protrusions 44, and four recesses 45.

Further, the inner rotor 40 rotates integrally with the rotation shaft 30 in the direction of the arrow R about the axis S.

The outer rotor 50 is formed as an internal gear having a tooth profile that can mesh with the inner rotor 40 by using a metal material such as steel or sintered steel. Then, as shown in FIGS. 5 to 7, the outer rotor 50 includes an end surface 51 that slides on the inner wall surface 11*b* of the housing body 10, an end surface 52 that slides on the inner wall surface 22*b* of the housing cover 20, a cylindrical outer peripheral surface 53 centered on the axis S1, five protrusions 54, and five recesses 55.

The outer peripheral surface 53 slidably contacts the arc surface 13*a* of the housing body 10.

The five protrusions 54 and the five recesses 55 are formed to partially mesh with the four protrusions 44 and the four recesses 45 of the inner rotor 40.

Then, the outer rotor 50 rotates in conjunction with the rotation of the inner rotor 40 that rotates about the axis S and rotates about the axis S1 in the same direction as the inner rotor 40 as shown in FIG. 8 at a speed slower than that of the inner rotor 40.

Further, when the inner rotor 40 and the outer rotor 50 partially mesh and rotate, the pump chamber Pc that expands and contracts is defined between the two, and the pumping action including the suction stroke and the pressurization and discharge stroke is continuously performed.

Next, the operation of the pump device M1 will be described with reference to FIGS. 9 to 12. Further, the operating state for each time series when the rotation shaft 30 and the inner rotor 40 rotate counterclockwise (in the direction of the arrow R) is shown. Here, the pump chamber Pc defined behind one protrusion 44 (marked with a black circle) of the inner rotor 40 in the rotation direction R will be described.

Figure 9:
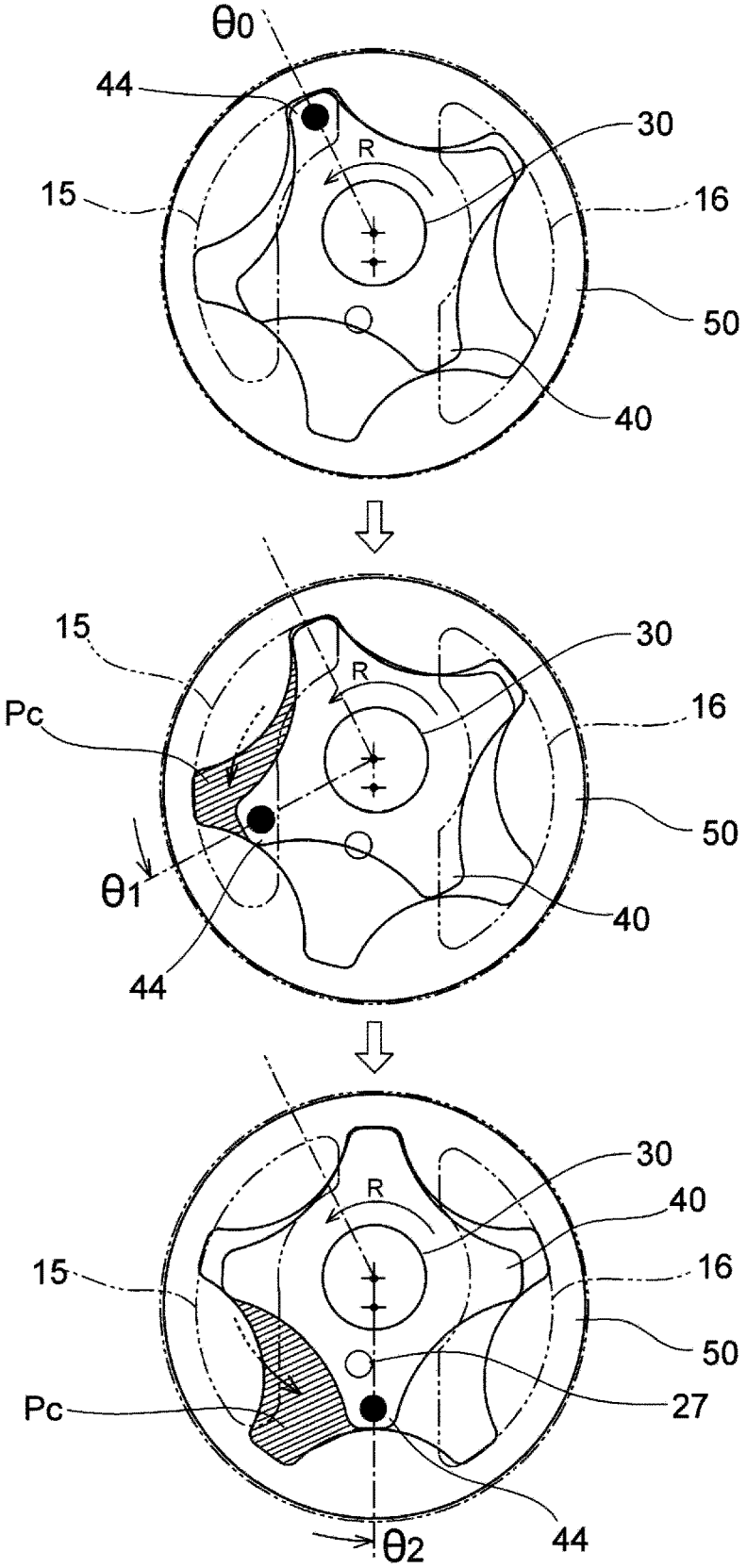
FIG. 9 is a schematic diagram showing an operation diagram of the pump device (inner rotor and outer rotor) according to the first embodiment.

First, as shown in FIG. 9, when the inner rotor 40 is at the rotation angle $\theta_0$, the suction stroke of sucking the hydraulic oil from the suction port 15 is started (at the start of the suction stroke).

Subsequently, when the inner rotor 40 rotates to the position of the rotation angle $\theta_1$ (here, about 90 degrees), the hydraulic oil is being sucked from the suction port 15 into the pump chamber Pc (suction stroke).

Subsequently, when the inner rotor 40 rotates to the position of the rotation angle $\theta_2$ (here, about 150 degrees), the hydraulic oil is being further sucked from the suction port 15 into the pump chamber Pc (suction stroke). Further, in this state, the pump chamber Pc becomes close to the air introduction hole 27, but the end surface 42 of the inner rotor 40 closes the air introduction hole 27.

Figure 10:
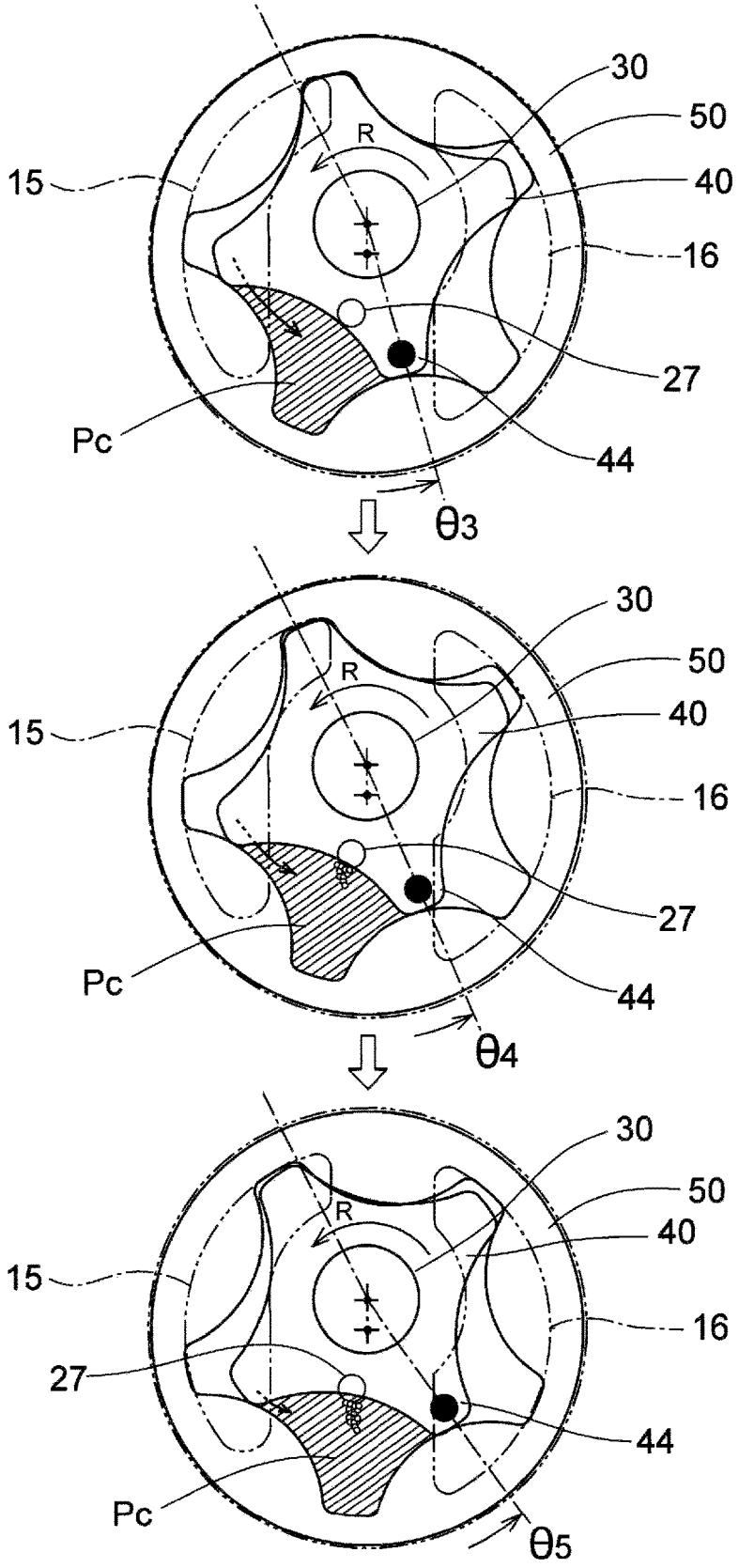
FIG. 10 is a schematic diagram showing an operation diagram of the pump device (inner rotor and outer rotor) according to the first embodiment.

Subsequently, as shown in FIG. 10, when the inner rotor 40 rotates to the position of the rotation angle $\theta_3$ (here, about 165 degrees), the hydraulic oil is further sucked from the suction port 15 into the pump chamber Pc in the suction stroke. However, the suction port 15 is squeezed and is becoming smaller. Further, in this state, the pump chamber Pc is adjacent to the air introduction hole 27, but the end surface 42 of the inner rotor 40 closes the air introduction hole 27.

Subsequently, when the inner rotor 40 rotates to the position of the rotation angle $\theta_4$ (here, about 172 degrees), it is just before the completion of the suction stroke in which the hydraulic oil is sucked from the suction port 15 to the pump chamber Pc, and the suction port 15 is squeezed, and the passage resistance increases. Therefore, when the rotation shaft 30 rotates at a particularly high rotation speed, the inflow of hydraulic oil into the pump chamber Pc cannot catch up, and the atmosphere in the pump chamber Pc is in a state of having a large negative pressure.

Immediately before the completion of this suction stroke, the end surface 42 of the inner rotor 40 is disengaged from the air introduction hole 27, and the air introduction hole 27 is opened. Therefore, due to the negative pressure of the pump chamber Pc, the outside air begins to be sucked into the pump chamber Pc through the air introduction hole 27.

Then, when the inner rotor 40 rotates to the position of the rotation angle $\theta_5$ (here, about 185 degrees), the suction stroke in which the hydraulic oil is sucked from the suction port 15 into the pump chamber Pc becomes closer to the completion point, and the air introduction hole 27 is still in an open state, and due to the negative pressure of the pump chamber Pc, the outside air continues to flow into the pump chamber Pc by the action of inertial force. As a result, the negative pressure of the pump chamber Pc is reduced.

Figure 11:
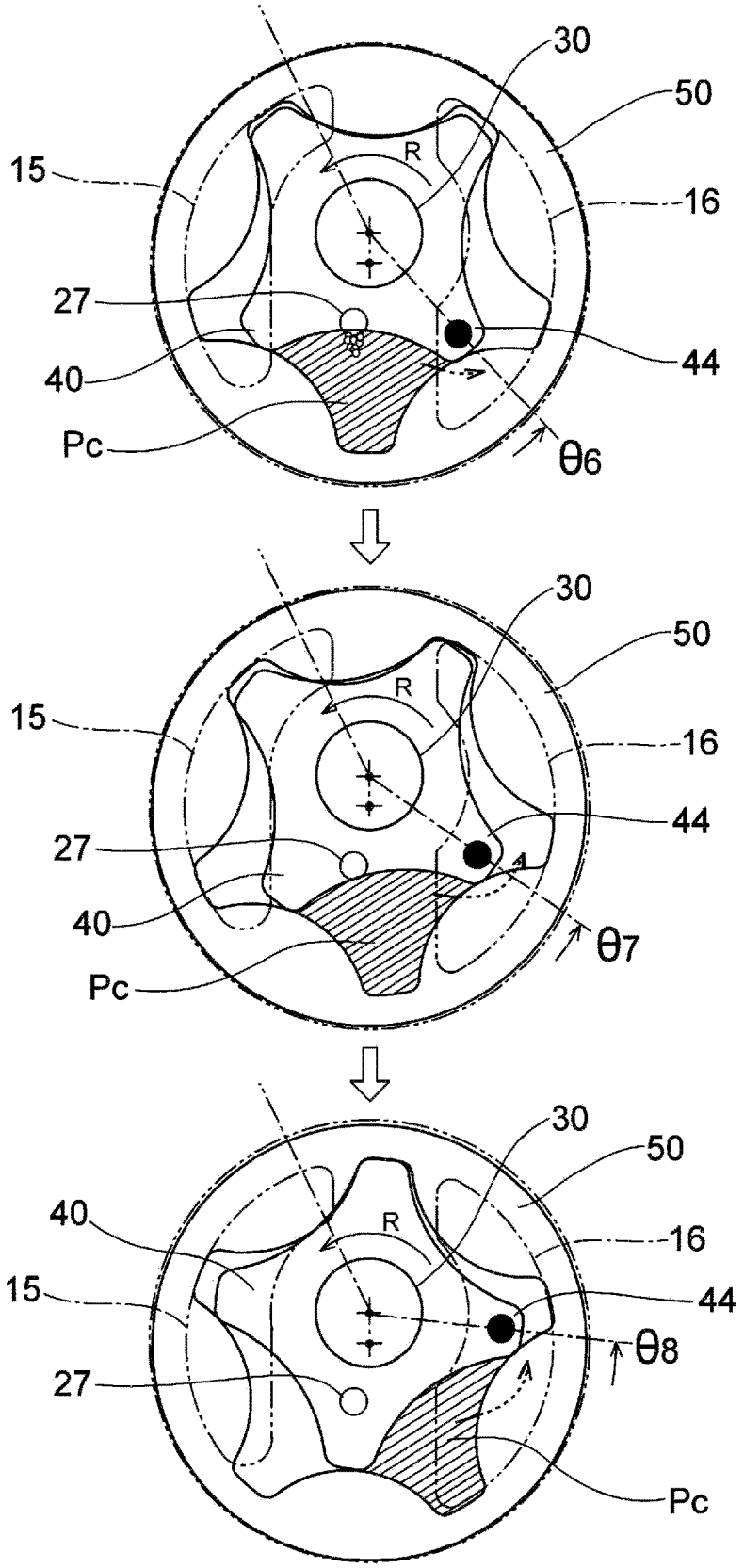
FIG. 11 is a schematic diagram showing an operation diagram of the pump device (inner rotor and outer rotor) according to the first embodiment.

Further, as shown in FIG. 11, when the inner rotor 40 rotates to the position of the rotation angle $\theta_6$ (here, about 192 degrees), the suction port 15 is closed and the suction stroke is completed. That is, the completion of the suction stroke is the time when the suction port 15 is closed.

At this time, the air introduction hole 27 is still open, and the outside air is in a state of flowing into the pump chamber Pc by the action of inertial force, and the negative pressure in the pump chamber Pc is sufficiently reduced in the process up to this point.

Further, the pump chamber Pc begins to communicate with the discharge port 16 in a narrow region, and the hydraulic oil in the pump chamber Pc begins to flow toward the discharge port 16 (at the start of the pressurization and discharge stroke).

In this way, when the suction stroke is completed and the process shifts to the pressurization and discharge stroke, the negative pressure in the pump chamber Pc is relieved by the introduced outside air (air), and the backflow of hydraulic oil in the pump chamber Pc in the previous stroke is suppressed or prevented. Further, since the backflow is suppressed or prevented, the increase in pressure due to the forward flow after the backflow is also suppressed or prevented.

Subsequently, when the inner rotor 40 rotates to the position of the rotation angle $\theta_7$ (here, about 205 degrees), the air introduction hole 27 is closed by the end surface 42 of the inner rotor 40. That is, the air introduction hole 27 is closed at a predetermined closing timing (rotation angle $\theta_7$) after the suction stroke is completed (rotation angle $\theta_6$). Then, the hydraulic oil in the pump chamber Pc is discharged from the discharge port 16 while being pressurized (pressurization and discharge stroke).

Figure 12:
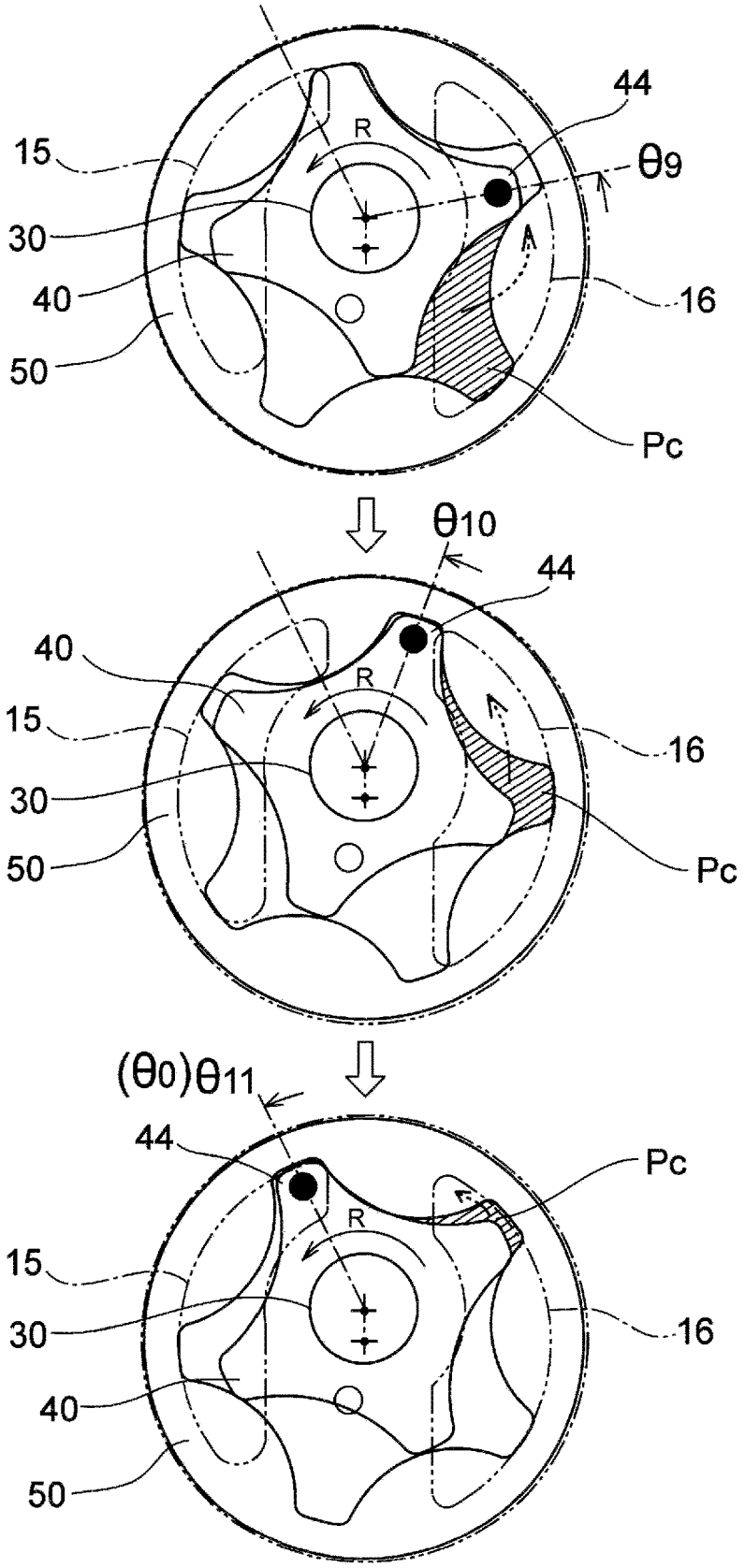
FIG. 12 is a schematic diagram showing an operation diagram of the pump device (inner rotor and outer rotor) according to the first embodiment.

Subsequently, the inner rotor 40 rotates to the position of the rotation angle $\theta_{11}$ via the position of the rotation angle $\theta_8$, the position of the rotation angle $\theta_9$, and the position of the rotation angle $\theta_{10}$, as shown in FIG. 12. In this process, the hydraulic oil in the pump chamber Pc continues to be discharged from the discharge port 16 while being pressurized (pressurization and discharge stroke). Further, at the position of the rotation angle $\theta_{11}$, the position returns to the position of the rotation angle $\theta_0$ shown in FIG. 9.

Here, the description has been made focusing on one protrusion 44, but in reality, the pump chambers Pc defined behind the four protrusions 44 each perform the same operation (pumping action). Therefore, the suction stroke and the pressurization and discharge stroke are continuously performed for four times while the rotation shaft 30 makes one rotation.

In the first embodiment, the opening timing at which the air introduction hole 27 is opened is set to the rotation angle $\theta_4$ about 20 degrees before the rotation angle $\theta_6$ at which the suction stroke is completed.

Specifically, when the rotation angle (rotation angle $\theta_6$−rotation angle $\theta_0$) of the inner rotor 40 over the range of the suction stroke is set to $\Theta$, and the rotation angle (rotation angle $\theta_6$-rotation angle $\theta_4$) of the inner rotor 40 from the opening timing (rotation angle $\theta_4$) to the completion of the suction stroke (rotation angle $\theta_6$) is set to $\Delta\Theta a$, $\Theta=192$ degrees, $\Delta\Theta a=192-172=20$ degrees, and $\Delta\Theta a=0.1\times\Theta$.

It is preferable that $\Delta\Theta a$ is set in the range of $0.08\times\Theta<\Delta\Theta a<0.12\times\Theta$ in consideration of the variation in assembly of parts and the allowable angle range in which air is efficiently introduced.

That is, the rotation angle $\Delta\Theta a$ of the inner rotor 40 from the opening timing to the completion of the suction stroke is very small with respect to the rotation angle $\Theta$ in the range of the suction stroke, and the opening timing is set before the completion of the suction stroke by about 10% of the rotation angle in the range of the suction stroke.

In other words, the opening timing at which the air introduction hole 27 is opened is set immediately before the suction stroke is completed.

Further, when the rotation angle (rotation angle $\theta_7$−rotation angle $\theta_6$) of the inner rotor 40 from the completion of the suction stroke (rotation angle $\theta_6$) to the closing timing (rotation angle $\theta_7$) at which the air introduction hole 27 is closed is set to $\Delta\Theta b$, $\Delta\Theta b=205-192=13$ degrees, and $\Delta\Theta b=0.65\times\Delta\Theta a$.

It is preferable that $\Delta\Theta b$ is set in the range of $0.6\times\Delta\Theta a<\Delta\Theta b<0.7\times\Delta\Theta a$ in consideration of the variation in assembly of parts and the allowable angle range in which air is efficiently introduced.

In other words, the closing timing at which the air introduction hole 27 is closed is set when the discharge port 16 starts communicating with the pump chamber Pc after the suction stroke is completed.

As described above, according to the pump device M1 according to the first embodiment, by providing the air introduction hole 27 that is opened to introduce air into the pump chamber Pc at a predetermined opening timing (rotation angle $\theta_4$) immediately before the suction stroke is completed, in particular, the negative pressure in the pump chamber Pc can be relieved at high rotation speeds.

Figure 13:
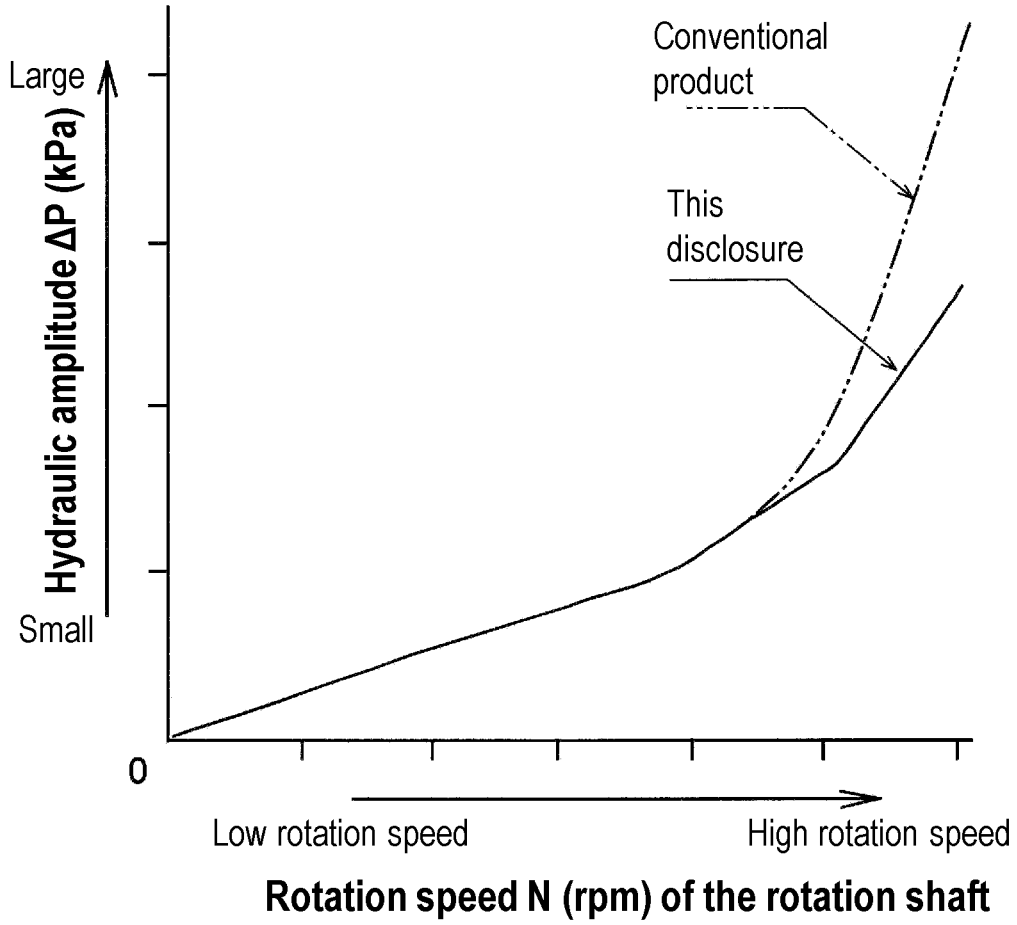
FIG. 13 is a graph showing the characteristics of hydraulic amplitude with respect to the rotation speed in the pump device of the disclosure and the conventional pump device.

As a result, as shown in FIG. 13, the hydraulic amplitude $\Delta P$ of the hydraulic oil can be reduced as compared with the conventional product, and the vibration and noise associated with the hydraulic amplitude $\Delta P$ can also be reduced.

In addition, it is possible to prevent the occurrence of cavitation due to excessive negative pressure and the occurrence of eclipse due to cavitation.

Further, by relieving the suction negative pressure, the drive torque for rotating the rotation shaft 30 can be reduced. In particular, at low temperature when the viscosity of the hydraulic oil is high, the shear torque of the hydraulic oil is relieved by introducing air into the hydraulic oil. As a result, the drive torque at low temperature can be reduced.

At the time of low rotation of the rotation shaft 30, the suction resistance is small, the negative pressure in the pump chamber Pc is also small, and the amount of air introduced from the air introduction hole 27 is small. On the other hand, at the time of high rotation of the rotation shaft 30, air is introduced in a state where the suction resistance is large and the suction of the hydraulic oil cannot catch up, and the rate of change in the volume of the pump chamber Pc in the region immediately before the completion of the suction stroke is less than or equal to 5%. Therefore, even if air is introduced, there is almost no difference between the intake amount and the discharge amount, and a desired discharge amount can be obtained.

Further, since the air introduction hole 27 is provided in the wall part of the housing H and is opened and closed by the end surface 42 of the inner rotor 40, compared with the case where a dedicated opening and closing valve is provided separately from the inner rotor 40, it is possible to achieve simplification of the structure, cost reduction, miniaturization, and the like.

Further, since the air introduction hole 27 is provided in the flat plate-shaped housing cover 20 configuring the housing H, it is only necessary to perform a hole drilling process, and the hole drilling process can be easily performed.

Figure 14:
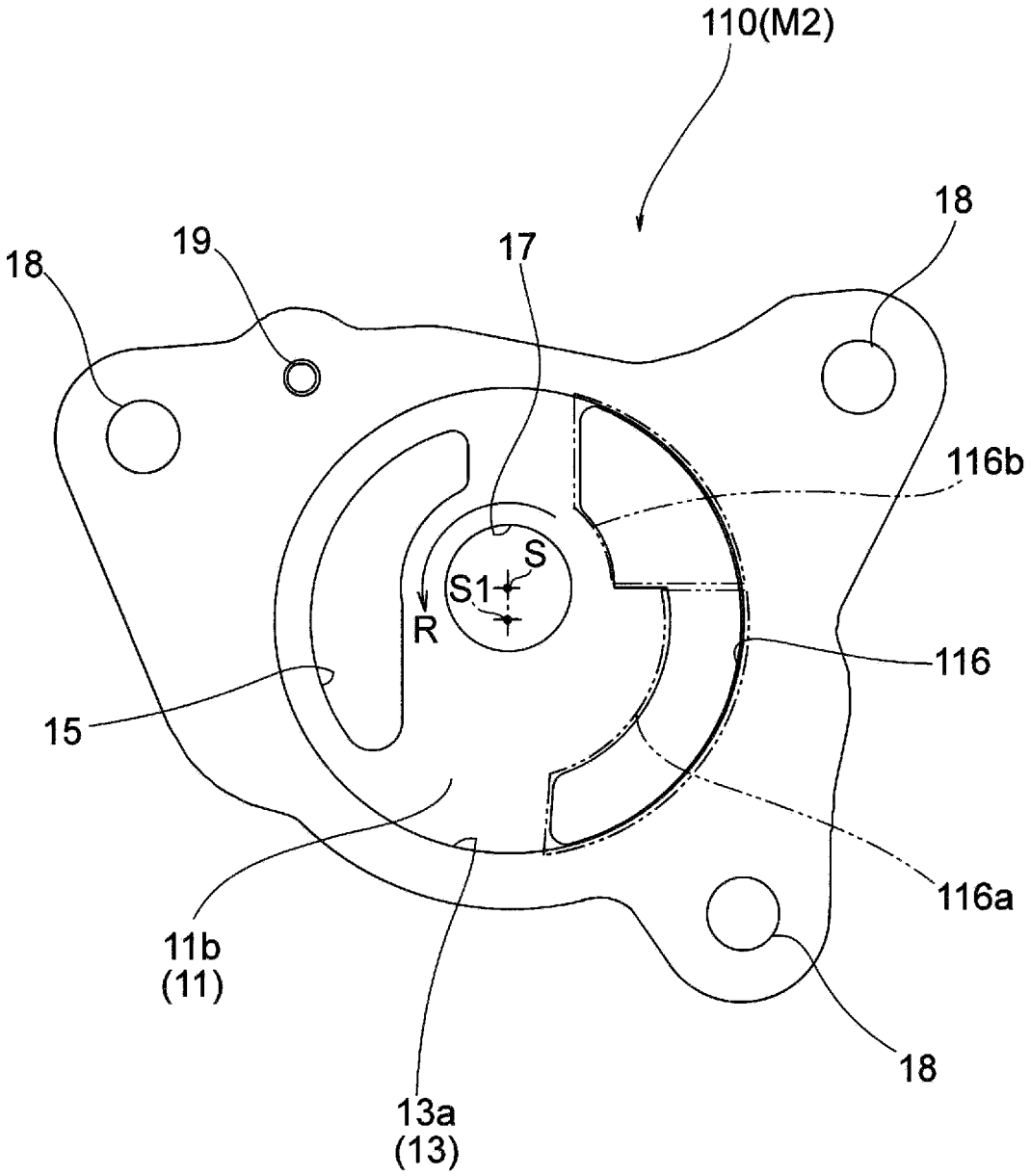
FIG. 14 is a front diagram of the housing body included in the pump device according to the second embodiment of the disclosure.

FIG. 14 shows the housing body 110 included in the pump device M2 according to the second embodiment of the disclosure, and the same components as those of the pump device M1 according to the first embodiment are designated by the same reference numerals, and the description thereof will be omitted.

The pump device M2 according to the second embodiment includes a housing body 110 and a housing cover 20 as a housing H, a rotation shaft 30 centered on a predetermined axis S, an inner rotor 40 and an outer rotor 50 as a pump unit Pu, and a screw b for fastening the housing cover 20 to the housing body 110.

The housing body 110 is formed in a bottomed tubular shape using a metal material such as steel, cast iron, sintered steel, aluminum alloy, or the like, and includes a joint wall 11, an outer peripheral wall 12, an accommodation chamber 13, an inlay part 14, a suction port 15, a discharge port 116, a bearing hole 17, three insertion holes 18, and one screw hole 19.

As shown in FIG. 14, the discharge port 116 is formed in a substantially crescent-shaped contour including a deviated opening region 116*a* that opens in deviation toward the outer peripheral side region of the accommodation chamber 13 and an enlarged opening region 116*b* that is enlarged and opens radially inward from the deviated opening region 116*a*.

Then, in the rotation direction R of the rotation shaft 30, the deviated opening region 116*a* occupies the first half region of the discharge port 116, and the enlarged opening region 116*b* occupies the second half region of the discharge port 116.

That is, the discharge port 116 is configured to include the deviated opening region 116*a* that is opened in deviation toward the outer peripheral side region to discharge the hydraulic oil pressurized by the pump chamber Pc from the outer peripheral side region of the outer rotor 50 away from the inner rotor 40 for a predetermined period from the start of the pressurization and discharge stroke.

Next, the operation of the pump device M2 will be described with reference to FIGS. 15 to 19. Further, the operating state for each time series when the rotation shaft 30 and the inner rotor 40 rotate counterclockwise (in the direction of the arrow R) is shown. Here, the pump chamber Pc defined behind one protrusion 44 (marked with a black circle) of the inner rotor 40 in the rotation direction R will be described.

Figure 15:
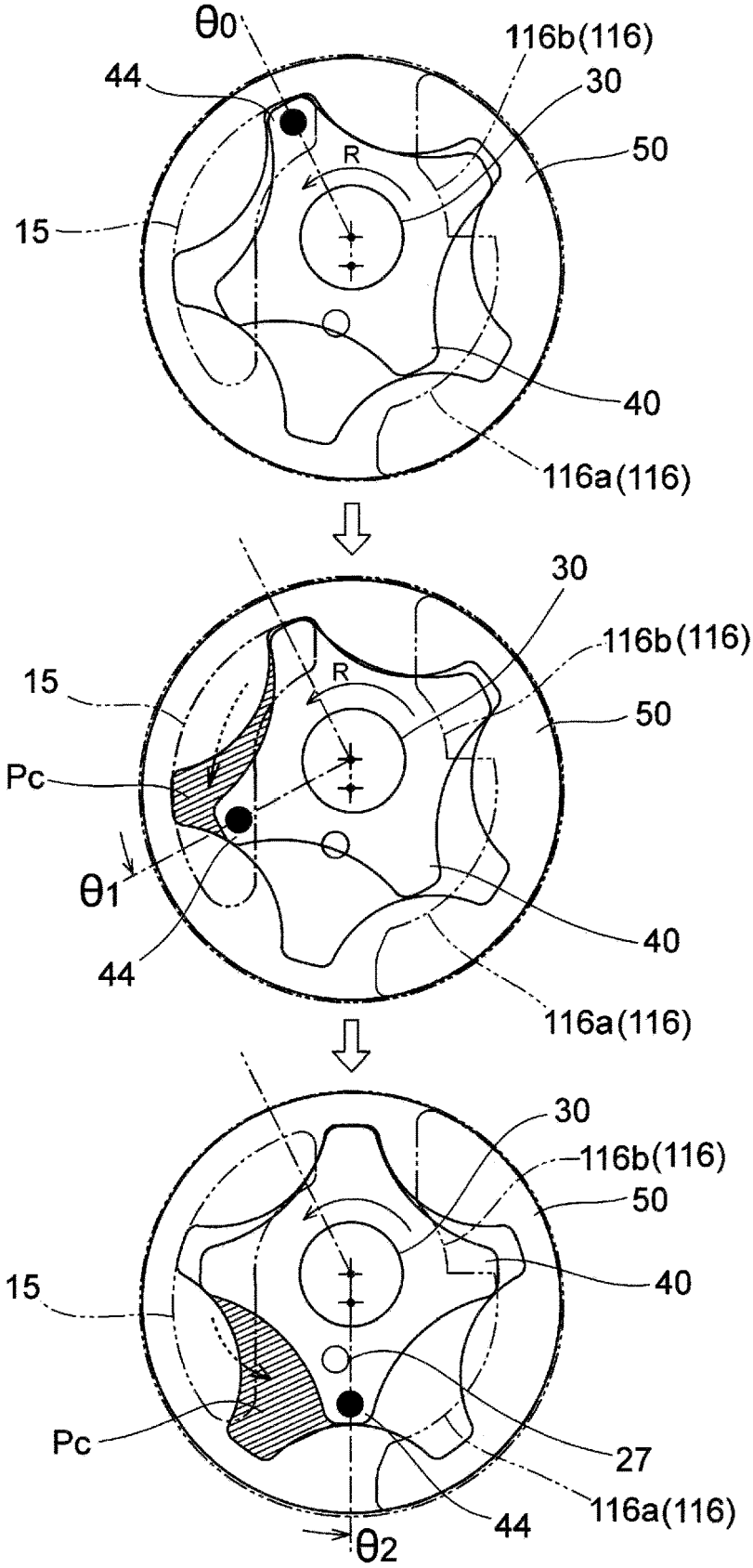
FIG. 15 is a schematic diagram showing an operation diagram of the pump device (inner rotor and outer rotor) according to the second embodiment.

First, as shown in FIG. 15, when the inner rotor 40 is at the rotation angle $\theta_0$, the suction stroke of sucking the hydraulic oil from the suction port 15 is started (at the start of the suction stroke).

Subsequently, when the inner rotor 40 rotates to the position of the rotation angle $\theta_1$ (here, about 90 degrees), the hydraulic oil is being sucked from the suction port 15 into the pump chamber Pc (suction stroke).

Subsequently, when the inner rotor 40 rotates to the position of the rotation angle $\theta_2$ (here, about 150 degrees), the hydraulic oil is being further sucked from the suction port 15 into the pump chamber Pc (suction stroke). Further, in this state, the pump chamber Pc becomes close to the air introduction hole 27, but the end surface 42 of the inner rotor 40 closes the air introduction hole 27.

Figure 16:
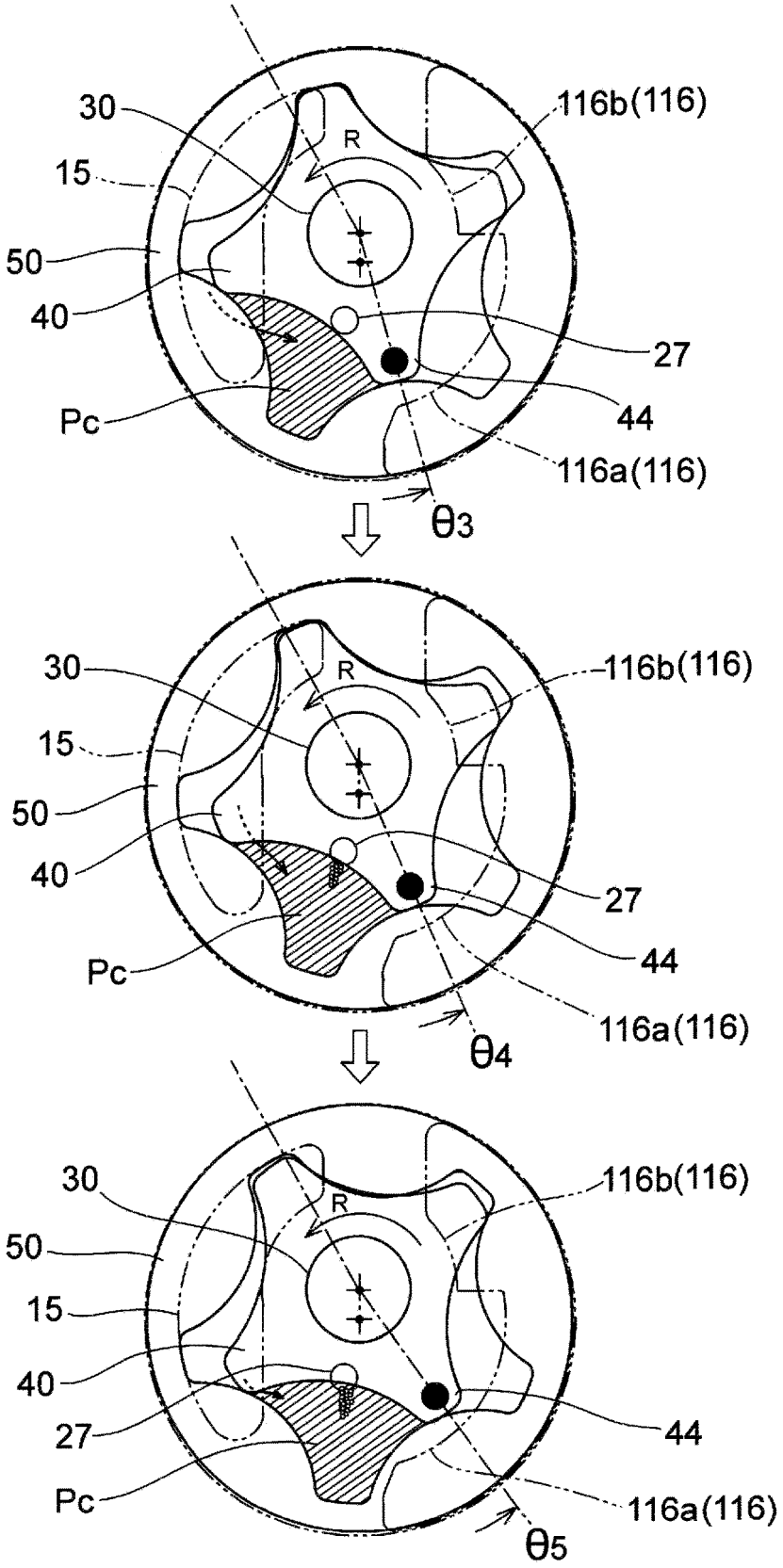
FIG. 16 is a schematic diagram showing an operation diagram of the pump device (inner rotor and outer rotor) according to the second embodiment.

Subsequently, as shown in FIG. 16, when the inner rotor 40 rotates to the position of the rotation angle $\theta_3$ (here, about 165 degrees), the hydraulic oil is further sucked from the suction port 15 into the pump chamber Pc in the suction stroke. However, the suction port 15 is squeezed and is becoming smaller. Further, in this state, the pump chamber Pc is adjacent to the air introduction hole 27, but the end surface 42 of the inner rotor 40 closes the air introduction hole 27.

Subsequently, when the inner rotor 40 rotates to the position of the rotation angle $\theta_4$ (here, about 172 degrees), it is just before the completion of the suction stroke in which the hydraulic oil is sucked from the suction port 15 to the pump chamber Pc, and the suction port 15 is squeezed, and the passage resistance increases. Therefore, when the rotation shaft 30 rotates at a particularly high rotation speed, the inflow of hydraulic oil into the pump chamber Pc cannot catch up, and the atmosphere in the pump chamber Pc is in a state of having a large negative pressure.

Immediately before the completion of this suction stroke, the end surface 42 of the inner rotor 40 is disengaged from the air introduction hole 27, and the air introduction hole 27 is opened. Therefore, due to the negative pressure of the pump chamber Pc, the outside air begins to be sucked into the pump chamber Pc through the air introduction hole 27.

Then, when the inner rotor 40 rotates to the position of the rotation angle $\theta_5$ (here, about 185 degrees), the suction stroke in which the hydraulic oil is sucked from the suction port 15 into the pump chamber Pc becomes closer to the completion point, and the air introduction hole 27 is still in an open state, and due to the negative pressure of the pump chamber Pc, the outside air continues to flow into the pump chamber Pc by the action of inertial force. As a result, the negative pressure of the pump chamber Pc is reduced.

Figure 17:
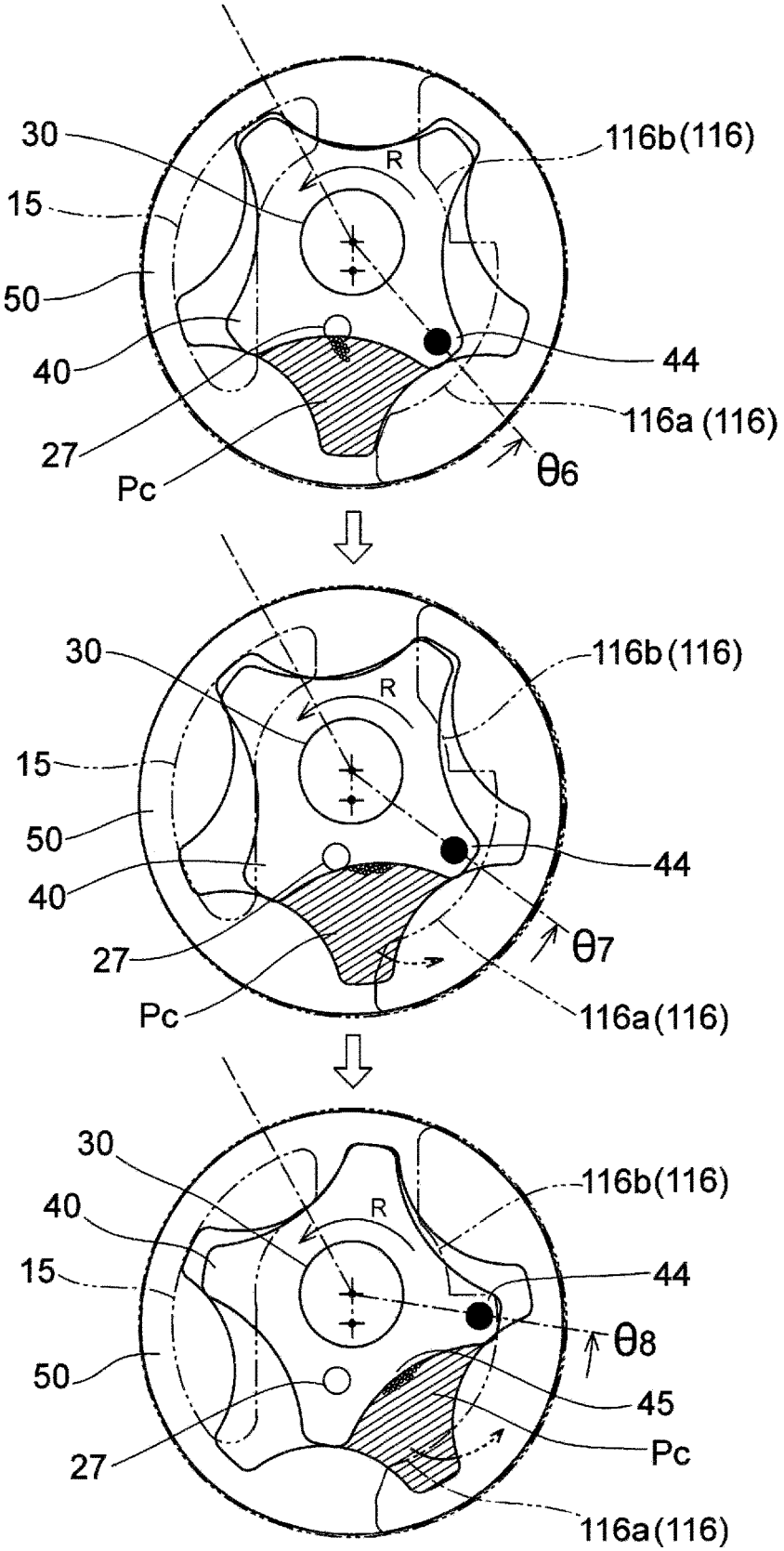
FIG. 17 is a schematic diagram showing an operation diagram of the pump device (inner rotor and outer rotor) according to the second embodiment.

Further, as shown in FIG. 17, when the inner rotor 40 rotates to the position of the rotation angle $\theta_6$ (here, about 192 degrees), the suction port 15 is closed and the suction stroke is completed. That is, the completion of the suction stroke is the time when the suction port 15 is closed.

At this time, the pump chamber Pc does not communicate with the discharge port 116 and is in a closed partition region. Further, the air introduction hole 27 is still open, and the outside air is in a state of flowing into the pump chamber Pc by the action of inertial force, and the negative pressure in the pump chamber Pc is sufficiently reduced in the process up to this point.

In this way, the negative pressure in the pump chamber Pc is relieved by the introduced outside air (air) before the suction stroke is completed and the process shifts to the pressurization and discharge strokes.

Subsequently, when the inner rotor 40 rotates to the position of the rotation angle $\theta_7$ (here, about 205 degrees), the air introduction hole 27 is closed by the end surface 42 of the inner rotor 40. Further, the pump chamber Pc begins to communicate with the deviated opening region 116*a* of the discharge port 116 in a narrow region, and the hydraulic oil in the pump chamber Pc begins to be discharged toward the discharge port 116 (at the start of the pressurization and discharge stroke).

At the start of this pressurization and discharge stroke, the negative pressure in the pump chamber Pc has already been relieved, so the backflow of hydraulic oil in the pump chamber Pc in the previous stroke is suppressed or prevented. Further, since the backflow is suppressed or prevented, the increase in pressure due to the forward flow after the backflow is also suppressed or prevented.

Subsequently, when the inner rotor 40 rotates to the position of the rotation angle $\theta_8$, the hydraulic oil in the pump chamber Pc is discharged while being pressurized from the deviated opening region 116*a* of the discharge port 116 to the downstream side of the discharge port 116. That is, the hydraulic oil pressurized by the pump chamber Pc is discharged from the outer peripheral side region of the outer rotor 50 away from the inner rotor 40 (pressurization and discharge stroke). At this time, the mixed air (air bubbles) is gathered in the region adjacent to the recess 45 of the inner rotor 40 without being discharged from the discharge port 116 due to the centrifugal force.

Figure 18:
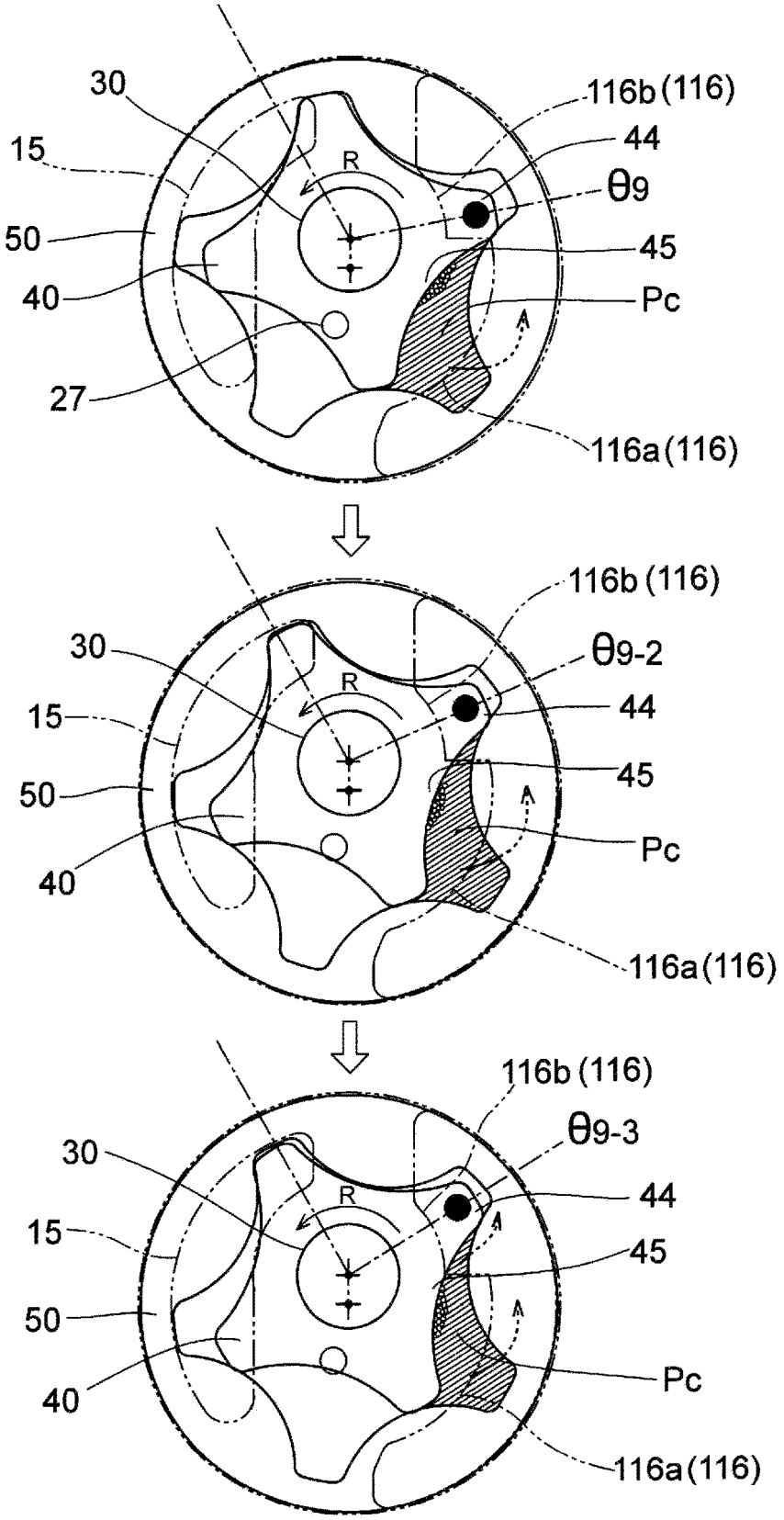
FIG. 18 is a schematic diagram showing an operation diagram of the pump device (inner rotor and outer rotor) according to the second embodiment.

Subsequently, as shown in FIG. 18, when the inner rotor 40 rotates to the position of the rotation angle $\theta_9$, the hydraulic oil in the pump chamber Pc is still discharged while being pressurized from the deviated opening region 116*a* of the discharge port 116 to the downstream side of the discharge port 116. Further, the mixed air (air bubbles) is still gathered in the region adjacent to the recess 45 of the inner rotor 40 without being discharged from the discharge port 116 due to the centrifugal force.

Subsequently, when the inner rotor 40 rotates to the position of the rotation angle $\theta_{9-3}$ via the position of the rotation angle $\theta_{9-2}$, the hydraulic oil in the pump chamber Pc is mainly discharged while being pressurized from the deviated opening region 116*a* to the downstream side of the discharge port 116, and is slightly discharged while being pressurized from the enlarged opening region 116*b* to the downstream side of the discharge port 116.

In this state, the mixed air (air bubbles) is crushed by pressure without being discharged from the discharge port 116 in a state of being gathered in the region adjacent to the recess 45 of the inner rotor 40 by the centrifugal force.

Figure 19:
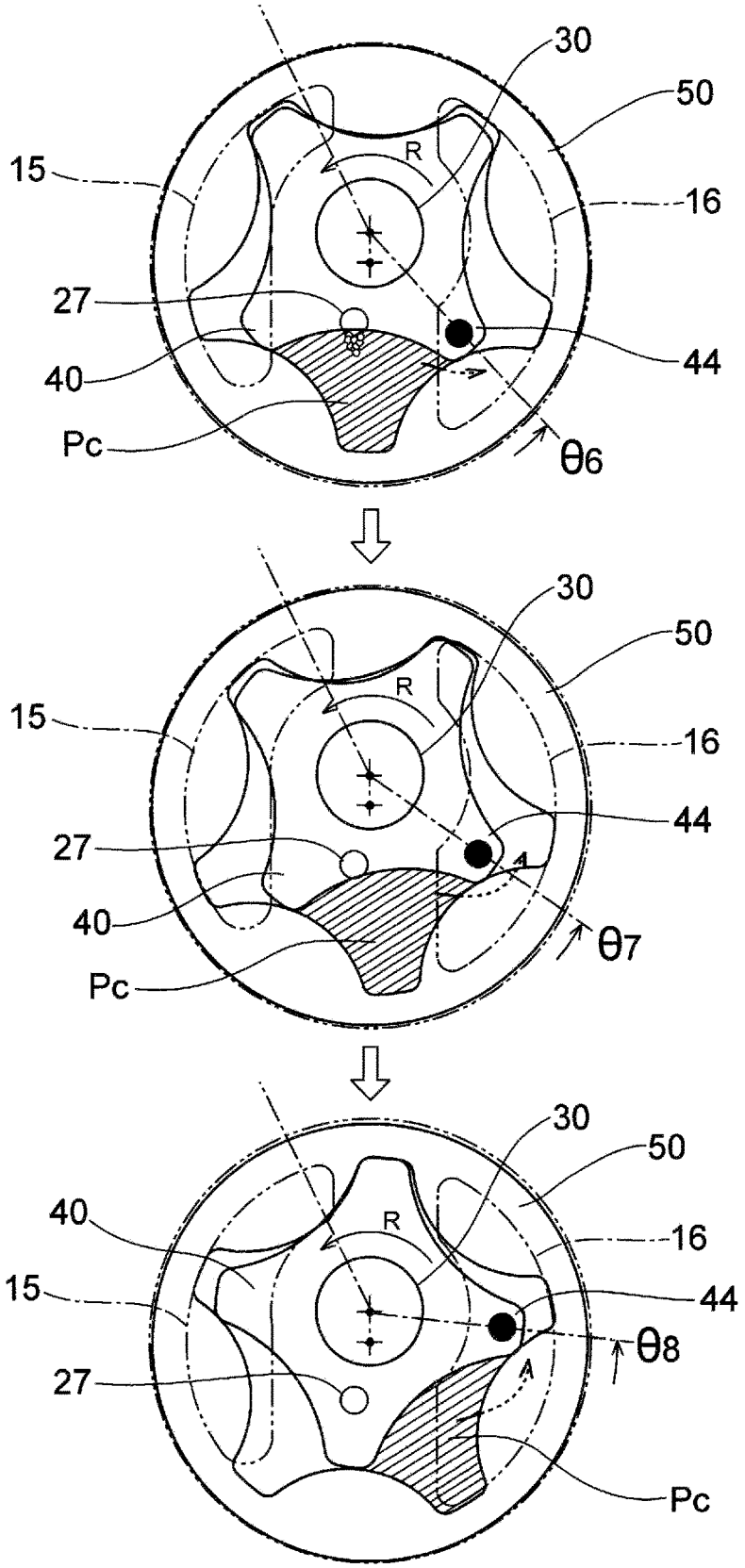
FIG. 19 is a schematic diagram showing an operation diagram of the pump device (inner rotor and outer rotor) according to the second embodiment.

Subsequently, as shown in FIG. 19, when the inner rotor 40 rotates to the position of the rotation angle $\theta_{9-4}$, the hydraulic oil in the pump chamber Pc is discharged while being pressurized from the deviated opening region 116*a* and the enlarged opening region 116*b* to the downstream side of the discharge port 116.

In this state, the mixed air (air bubbles) is in a state of being gathered in the region adjacent to the recess 45 of the inner rotor 40 by the centrifugal force without being discharged from the discharge port 116, is crushed by pressure, melts into the hydraulic oil and almost disappears.

Subsequently, the inner rotor 40 rotates to the position of the rotation angle $\theta_{11}$ via the position of the rotation angle $\theta_{10}$. In this process, the hydraulic oil in the pump chamber Pc continues to be discharged from the discharge port 116 while being pressurized (pressurization and discharge stroke). Further, at the position of the rotation angle $\theta_{11}$, the position returns to the position of the rotation angle $\theta_0$ shown in FIG. 15.

Here, the description has been made focusing on one protrusion 44, but in reality, the pump chambers Pc defined behind the four protrusions 44 each perform the same operation (pumping action). Therefore, the suction stroke and the pressurization and discharge stroke are continuously performed for four times while the rotation shaft 30 makes one rotation.

In the second embodiment, the opening timing at which the air introduction hole 27 is opened is set to the rotation angle $\theta_4$ about 20 degrees before the rotation angle $\theta_6$ at which the suction stroke is completed.

That is, the opening timing at which the air introduction hole 27 is opened is set immediately before the suction stroke is completed.

Further, the closing timing at which the air introduction hole 27 is closed is set when the deviated opening region 116*a* of the discharge port 116 starts communicating with the pump chamber Pc after the suction stroke is completed.

In particular, since the discharge port 116 is formed to include the deviated opening region 116*a*, from the start of the pressurization and discharge stroke to a predetermined period, the hydraulic oil pressurized by the pump chamber Pc can be discharged from the outer peripheral side region of the outer rotor 50 away from the inner rotor 40 without discharging the introduced air (air bubbles). As a result, the introduced air (air bubbles) can be used as a damper means for absorbing and attenuating the high pressure side of the hydraulic pressure fluctuation, and the hydraulic amplitude can be efficiently reduced.

As described above, according to the pump device M2 according to the second embodiment, as in the first embodiment, the hydraulic amplitude ΔP of the hydraulic oil can be reduced as compared with the conventional product, and the vibration and noise associated with the hydraulic amplitude ΔP can also be reduced. In addition, it is possible to prevent the occurrence of cavitation due to excessive negative pressure and the occurrence of eclipse due to cavitation, and it is possible to achieve simplification of the structure, cost reduction, miniaturization and the like.

Further, by relieving the suction negative pressure, the drive torque for rotating the rotation shaft 30 can be reduced. In particular, at low temperature when the viscosity of the hydraulic oil is high, the shear torque of the hydraulic oil is relieved by introducing air into the hydraulic oil. As a result, the drive torque at low temperature can be reduced.

Figure 20:
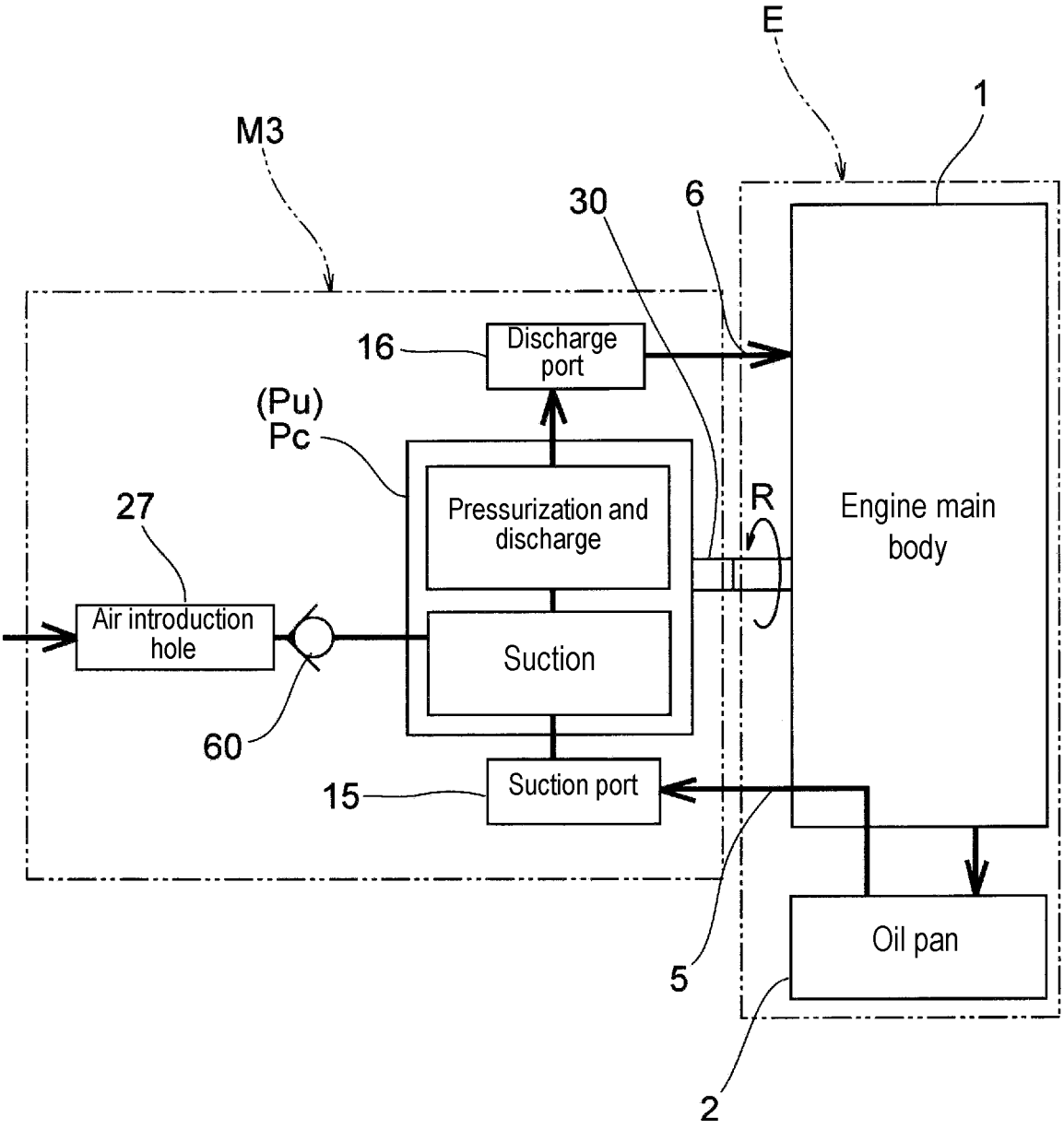
FIG. 20 is a block diagram of a system in which a pump device according to the third embodiment of the disclosure is applied to an application object (internal combustion engine).

FIG. 20 is a block diagram of a system in which the pump device M3 according to the third embodiment of the disclosure is applied to the internal combustion engine E, and the same components as those in the above-described embodiments are designated by the same reference numerals, and description thereof will be omitted.

The pump device M3 according to the third embodiment includes a housing body 10 and a housing cover 20 as a housing H, a rotation shaft 30 centered on a predetermined axis S, an inner rotor 40 and an outer rotor 50 as a pump unit Pu, a check valve 60, and a screw b for fastening the housing cover 20 to the housing body 10.

The check valve 60 is arranged, for example, on the downstream side of the air introduction hole 27 of the housing cover 20. Then, the check valve 60 opens when the pressure in the pump chamber Pc becomes a negative pressure of a predetermined level or less, allows a one-way air flow in which the outside air flows into the pump chamber Pc through the air introduction hole 27, and blocks the hydraulic oil from flowing out from the pump chamber Pc to the outside.

According to the pump device M3 according to the third embodiment, the same effects as those of the above-described embodiments can be achieved; in addition, even if the pressure in the pump chamber Pc rises, it is possible to reliably prevent the hydraulic oil from flowing out to the outside.

Figure 21:
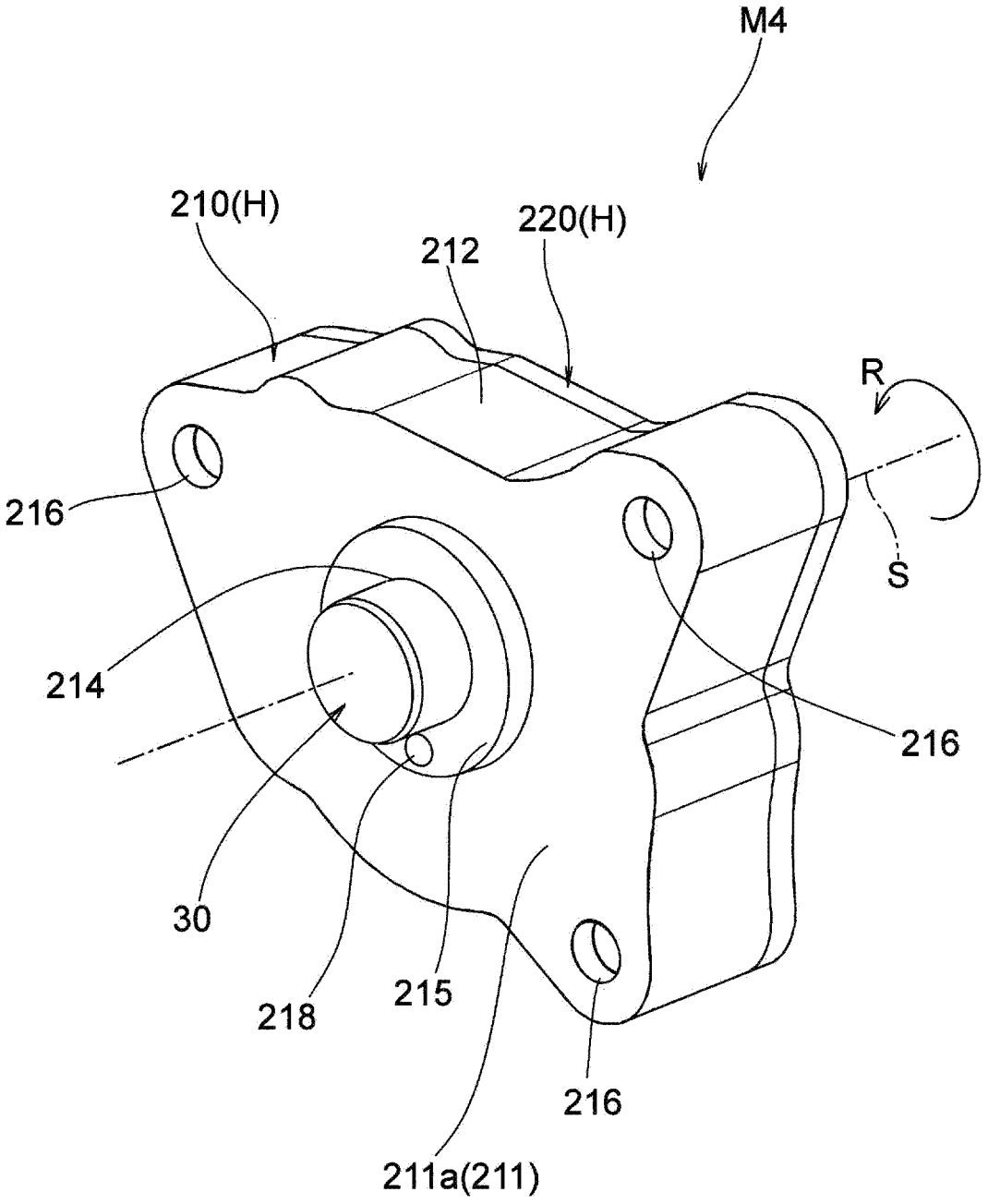
FIG. 21 is an external perspective diagram of the pump device according to the fourth embodiment of the disclosure as viewed from the side opposite to the joint wall where the pump device is joined to the application object.
Figure 22:
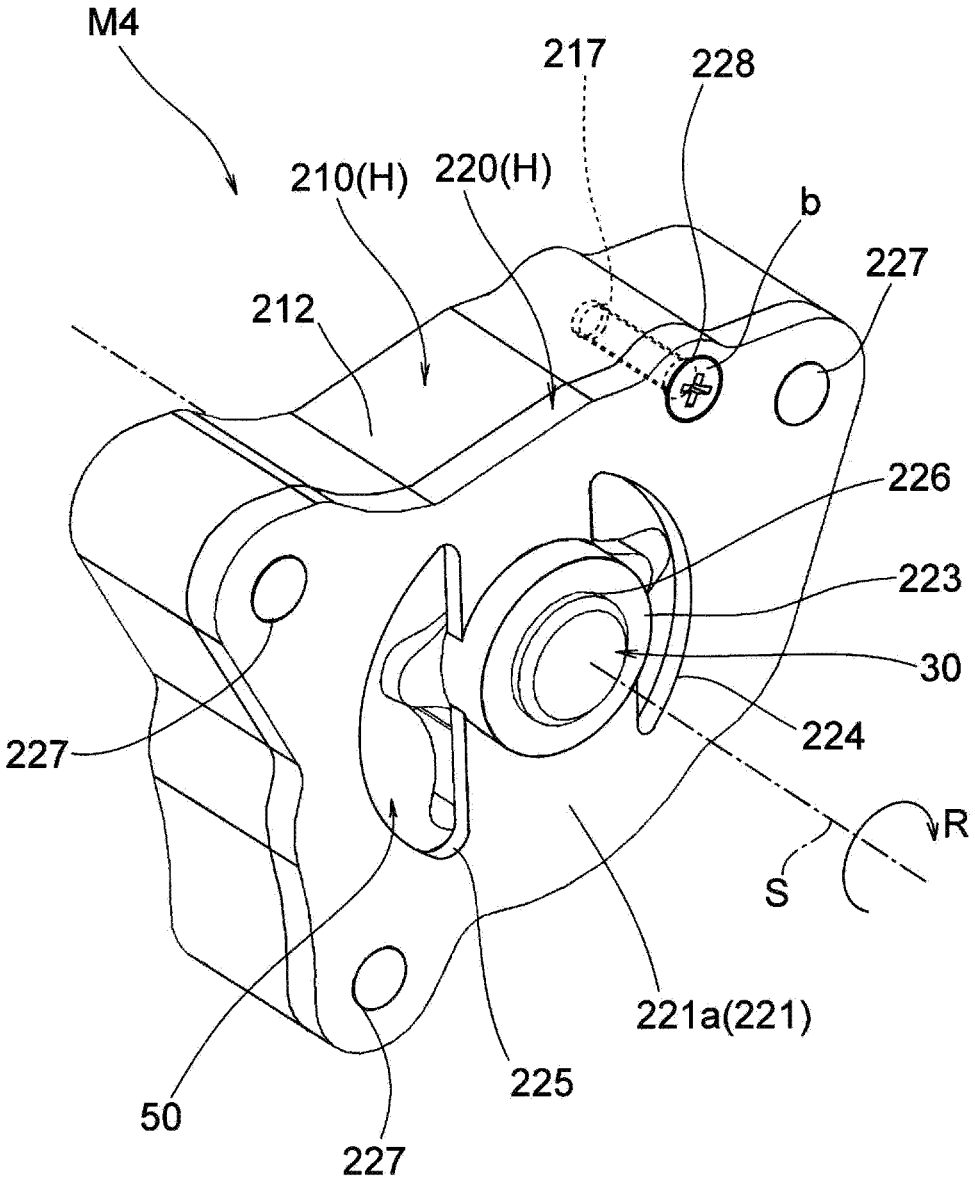
FIG. 22 is an external perspective diagram of the pump device according to the fourth embodiment as viewed from the joint wall side where the pump device is joined to the application object.
Figure 23:
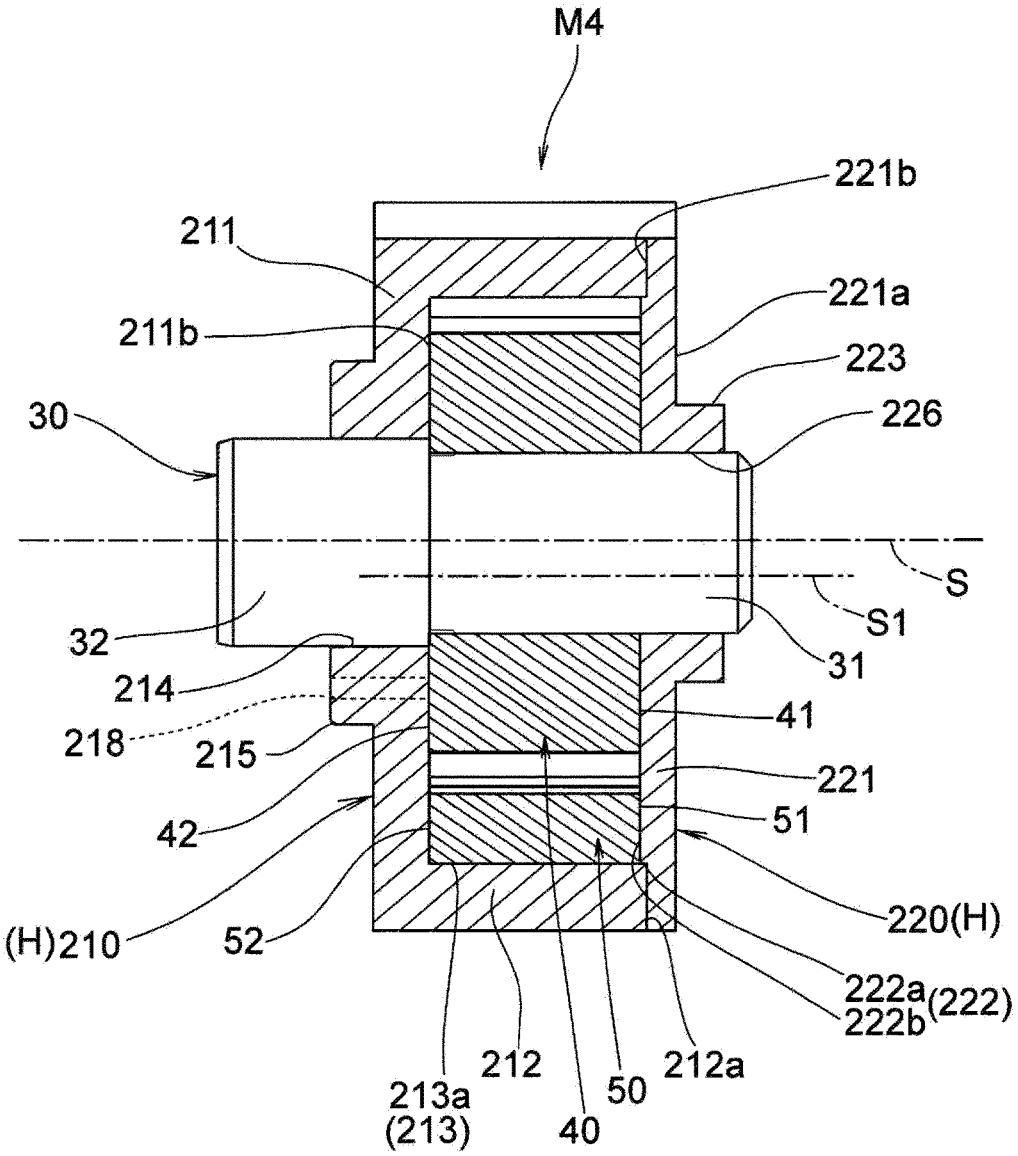
FIG. 23 is a cross-sectional diagram of the pump device according to the fourth embodiment cut along a plane passing through the axis of the rotation shaft.

FIGS. 21 to 23 show the pump device M4 according to the fourth embodiment of the disclosure, and the same components as those in the above-described embodiments are designated by the same reference numerals, and description thereof will be omitted.

The pump device M4 according to the fourth embodiment includes a housing body 210 and a housing cover 220 as a housing H, a rotation shaft 30 centered on a predetermined axis S, an inner rotor 40 and an outer rotor 50 as a pump unit Pu, and a screw b for fastening the housing cover 220 to the housing body 210.

The housing body 210 is formed in a bottomed tubular shape using a metal material such as steel, cast iron, sintered steel, aluminum alloy, or the like, and includes a bottom wall 211, an outer peripheral wall 212, an accommodation chamber 213, a bearing hole 214, an annular protrusion 215, three insertion holes 216, one screw hole 217, and an air introduction hole 218.

The bottom wall 211 is formed as a flat wall perpendicular to the axis S, and defines an outer wall surface 211*a* and an inner wall surface 211*b* on which end surfaces 42 and 52 of the pump unit Pu slide in close contact with each other.

The outer peripheral wall 212 protrudes from the outer edge region of the bottom wall 211 in a tubular shape in the axis S direction to define an annular end surface 212*a*.

The accommodation chamber 213 is a space defined by the bottom wall 211 and the outer peripheral wall 212, and rotatably accommodates the pump unit Pu.

Further, as shown in FIG. 23, the accommodation chamber 213 includes an arc surface 213*a* forming a cylindrical surface centered on an axis S1 deviated in parallel from the axis S.

The arc surface 213*a* slidably supports an outer peripheral surface 53 of the outer rotor 50 forming a part of the pump unit Pu. Further, the inner edge part of the arc surface 213*a* also functions as a fitting recess into which a fitting protrusion 222 of the housing cover 220 is fitted.

The bearing hole 214 is formed in a cylindrical shape centered on the axis S to rotatably support an other-end-side region 32 of the rotation shaft 30.

The annular protrusion 215 is formed in a cylindrical shape around the bearing hole 214 to protrude outward in the axis S direction in order to increase the mechanical strength.

The three insertion holes 216 are for inserting the bolts B to be screwed into the screw holes 7 of the engine main body 1, and are formed to penetrate from the outer wall surface 211*a* to the end surface 212*a* in the axis S direction.

The one screw hole 217 is formed in the end surface 212*a* for screwing the screw b that connects the housing cover 220 to the housing body 210.

The air introduction hole 218 is formed as a circular hole penetrating in the axis S direction in the wall part located in the region of the annular protrusion 215 and in the region of the inner wall surface 211*b* on which the inner rotor 40 slides in order to introduce the outside air into the pump chamber Pc defined by the pump unit Pu.

Further, the air introduction hole 218 is opened by the end surface 42 of the inner rotor 40 at a predetermined opening timing immediately before the suction stroke by the pump unit Pu is completed, and is closed by the end surface 42 of the inner rotor 40 at a predetermined closing timing after the suction stroke is completed.

Here, since the air introduction hole 218 is provided on the wall part of the housing H and is opened and closed by the end surface 42 of the inner rotor 40, compared with the case where a dedicated opening and closing valve is provided separately from the inner rotor 40, it is possible to achieve simplification of the structure, cost reduction, miniaturization, and the like.

Further, since the air introduction hole 218 is provided in the bottom wall 211 of the bottomed tubular-shaped housing body 210 configuring the housing H, it is only necessary to perform a hole drilling process, and the hole drilling process can be easily performed.

The housing cover 220 is combined to the housing body 210 to close the accommodation chamber 213 of the housing body 210, and is formed in a flat plate shape using a material such as steel, cast iron, sintered steel, or an aluminum alloy.

The housing cover 220 includes a joint wall 221, a fitting protrusion 222, an inlay part 223, a suction port 224, a discharge port 225, a bearing hole 226, three insertion holes 227, and one circular hole 228.

The joint wall 221 is formed as a flat wall perpendicular to the axis S, and defines an outer wall surface 221*a* joined to the joint surface 3 of the engine main body 1 and an inner wall surface 221*b* joined to the end surface 212*a* of the housing body 210.

The fitting protrusion 222 is formed in a disk shape near the center of the housing cover 220 to protrude from the joint wall 221 in the axis S direction with the axis S1 as the center, and defines an outer peripheral surface 222*a* and an inner wall surface 222*b*. The outer peripheral surface 222*a* is fitted to the inner edge part of the arc surface 213*a* of the housing body 210. The end surfaces 41 and 51 of the pump unit Pu slidably come into close contact with the inner wall surface 222*b*.

The inlay part 223 protrudes outward from the joint wall 221 in the axis S direction and is formed in a cylindrical shape centered on the axis S, and is closely fitted to the fitting recess 4 of the engine main body 1.

The suction port 224 has the same shape as the suction port 15 according to the above-described embodiment, and as shown in FIG. 22, is formed in the joint wall 221 to form a substantially crescent-shaped contour to penetrate in the axis S direction. Then, in a state where the pump device M4 is joined to the joint surface 3 of the engine main body 1, the hydraulic oil guided from the outflow passage 5 is sucked into a pump chamber Pc through the suction port 224.

The discharge port 225 has the same shape as the discharge port 16 according to the above-described embodiment, and as shown in FIG. 22, is formed in a substantially crescent-shaped contour to penetrate in the axis S direction in a region of the joint wall 221 on the side opposite to the suction port 224 with the inlay part 223 interposed therebetween. Then, in a state where the pump device M4 is joined to the joint surface 3 of the engine main body 1, the hydraulic oil pressurized in the pump chamber Pc is discharged toward the inflow passage 6 through the discharge port 225.

The bearing hole 226 is formed in a cylindrical shape centered on the axis S inside the inlay part 223 to rotatably support a one-end-side region 31 of the rotation shaft 30.

The three insertion holes 227 are for inserting the bolts B to be screwed into the screw holes 7 of the engine main body 1, and are formed as circular holes penetrating in the axis S direction at positions corresponding to the three insertion holes 216 of the housing body 210.

The one circular hole 228 is for passing a screw b that connects the housing cover 220 to the housing body 210, and is formed near the one insertion hole 227.

As described above, the housing H includes the bottomed tubular housing body 210 which defines the accommodation chamber 213 and the flat plate-shaped housing cover 220 which defines the suction port 224, the discharge port 225, the joint wall 221 to be joined to the application object and which is combined to the housing body 210 to close the accommodation chamber 213; and the air introduction hole 218 is provided in the housing body 210.

As described above, since the air introduction hole 218 is provided in the housing H in the region opposite to the side to be joined to the application object, there is no obstacle on the outside of the air introduction hole 218 and air (outside air) can be smoothly introduced into the pump chamber Pc.

According to the pump device M4 according to the fourth embodiment, as in the above-described embodiments, the hydraulic amplitude ΔP of the hydraulic oil can be reduced as compared with the conventional product, and the vibration and noise associated with the hydraulic amplitude ΔP can also be reduced. In addition, it is possible to prevent the occurrence of cavitation due to excessive negative pressure and the occurrence of eclipse due to cavitation, and it is possible to achieve simplification of the structure, cost reduction, miniaturization and the like.

Further, by relieving the suction negative pressure, the drive torque for rotating the rotation shaft 30 can be reduced. In particular, at low temperature when the viscosity of the hydraulic oil is high, the shear torque of the hydraulic oil is relieved by introducing air into the hydraulic oil. As a result, the drive torque at low temperature can be reduced.

Further, in the pump device M4 according to the fourth embodiment, a discharge port having the same form as the discharge port 116 according to the second embodiment may be adopted, and the check valve 60 according to the third embodiment may be adopted.

In the above embodiments, the pump unit Pu including the trochoid rotors (inner rotor 40 and outer rotor 50) having a trochoidal tooth profile is shown as the pump unit exerting the pumping action, but the disclosure is not limited thereto.

For example, a rotor unit including an inner rotor and an outer rotor having a tooth profile other than the trochoidal tooth profile may be adopted. Further, the disclosure is not limited to the pump unit including the inner rotor and the outer rotor, and other positive displacement pump units may be adopted.

In the above embodiments, the inner rotor 40 and the outer rotor 50 configuring the pump unit Pu have been shown to be composed of four blades and five nodes forming a trochoidal tooth profile, but the disclosure is not limited thereto, and a configuration composed of other numbers may be adopted.

In the above embodiments, the end surface 42 of the inner rotor 40 is used to open and close the air introduction holes 27 and 218 provided in the housing H, but the disclosure is not limited thereto. The location of the air introduction hole may be changed, and the air introduction hole may be opened and closed by the end surface 52 of the outer rotor 50.

In the above embodiments, the housing cover 20 or the housing body 210 configuring the housing H is provided with the air introduction holes 27 and 218 by drilling holes, but a filter member for removing suspended matter in the outside air may be installed in the middle of the passage including the air introduction holes 27 and 218.

In the above embodiment, an internal combustion engine mounted on an automobile or the like is shown as an application object to which the pump devices M1, M2, M3 and M4 are applied, but the disclosure is not limited thereto, and it may be applied to a transmission or other lubricating equipment, or may be applied to a fluid equipment using fluids other than hydraulic oil.

In the above embodiments, the housing H of the pump devices M1, M2, M3, and M4 is provided with the joint walls 11 and 221 to be joined to the application object, but the disclosure is not limited thereto, and it may be applied to a system in which the fluid is sucked and discharged through a connecting pipe or the like, and may be arranged independently instead of being joined to the application object. In this case, the air introduction hole is not limited to the side opposite to the joint wall, and may be provided in a suitable region of the housing.

As described above, the pump device of the disclosure can suppress the hydraulic amplitude while achieving the simplification of the structure, and can also reduce the noise or vibration associated therewith. Therefore, not only can it be applied to an internal combustion engine of an automobile or a two-wheeled vehicle, but it can also be applied to other lubricating equipment, and it is also useful in fluid equipment that handles fluids other than hydraulic oil.

What is claimed is:

1. A pump device comprising:

a housing which defines a suction port, a discharge port, and an accommodation chamber; and a pump unit which is arranged in the accommodation chamber and which defines a pump chamber that expands and contracts to exert a pumping action including a suction stroke and a pressurization and discharge stroke on a fluid, wherein the housing includes an air introduction hole that is opened to introduce air into the pump chamber at a predetermined opening timing immediately before the suction stroke is completed while the fluid does not continue to flow into the pump chamber, wherein the pump unit includes an inner rotor that rotates around a predetermined axis and an outer rotor that rotates in conjunction with the rotation of the inner rotor, wherein when a rotation angle of the inner rotor over a range of the suction stroke is $\Theta$, and a rotation angle of the inner rotor from the opening timing to the completion of the suction stroke is $\Delta\Theta a$, $\Delta\Theta a$ is set in a range of $0.08\times\Theta<\Delta\Theta a<0.12\times\Theta$.

2. The pump device according to claim 1, wherein the air introduction hole is closed at a predetermined closing timing after the suction stroke is completed.

3. The pump device according to claim 1, wherein the housing includes the air introduction hole in a wall part on which an end surface of the inner rotor and an end surface of the outer rotor slide.

4. The pump device according to claim 3, wherein the air introduction hole is provided at a position where it is opened and closed by the end surface of the inner rotor.

5. The pump device according to claim 1, wherein the discharge port includes a deviated opening region that is opened in deviation toward an outer peripheral side region of the outer rotor to discharge a fluid pressurized by the pump chamber from the outer peripheral side region of the outer rotor away from the inner rotor for a predetermined period from the start of the pressurization and discharge stroke.

6. The pump device according to claim 1, wherein the inner rotor and the outer rotor are trochoid rotors each having a trochoidal tooth profile of four blades and five nodes.

7. The pump device according to claim 1, further comprising:

a check valve which allows only air flow introduced from the air introduction hole into the pump chamber.

8. The pump device according to claim 1, wherein the housing comprises:

a housing body in a bottomed tubular shape which defines the suction port, the discharge port, a joint wall to be joined to an application object, and the accommodation chamber; and a housing cover in a flat plate shape which is combined to the housing body to close the accommodation chamber, and the air introduction hole is provided in the housing cover.

9. The pump device according to claim 1, wherein the housing comprises:

a housing body in a bottomed tubular shape which defines the accommodation chamber; and a housing cover in a flat plate shape which defines the suction port, the discharge port, and a joint wall to be joined to an application object, and which is combined to the housing body to close the accommodation chamber, and the air introduction hole is provided in the housing body.

10. A pump device comprising:

a housing which defines a suction port, a discharge port, and an accommodation chamber; and a pump unit which is arranged in the accommodation chamber and which defines a pump chamber that expands and contracts to exert a pumping action including a suction stroke and a pressurization and discharge stroke on a fluid, wherein the housing includes an air introduction hole that is opened to introduce air into the pump chamber at a predetermined opening timing immediately before the suction stroke is completed while the fluid does not continue to flow into the pump chamber, wherein the pump unit includes an inner rotor that rotates around a predetermined axis and an outer rotor that rotates in conjunction with the rotation of the inner rotor, wherein when a rotation angle of the inner rotor over a range of the suction stroke is $\Theta$, and a rotation angle of the inner rotor from the opening timing to the completion of the suction stroke is $\Delta\Theta a$, and a rotation angle of the inner rotor from the completion of the suction stroke to the closing timing is $\Delta\Theta b$, $\Delta\Theta a$ is set in a range of $0.08\times\Theta<\Delta\Theta a<0.12\times\Theta$, and $\Delta\Theta b$ is set in a range of $0.6\times\Delta\Theta a<\Delta\Theta b<0.7\times\Delta\Theta a$.

* * * * *